US011633706B2

(12) United States Patent
Müller et al.

(10) Patent No.: US 11,633,706 B2
(45) Date of Patent: Apr. 25, 2023

(54) DISPENSER FOR VISCOUS MATERIALS

(71) Applicant: SHIN-ETSU SILICONES EUROPE B.V., Wiesbaden (DE)

(72) Inventors: Gerhard Müller, Aichtal (DE); Kin Saito, Frankfurt a.M. (DE); Makoto Ohara, Frankfurt a.M. (DE); Dennis Tenhünfeld, Wiesbaden (DE)

(73) Assignee: SHIN-ETSU SILICONES EUROPE B.V., Wiesbaden (DE)

( * ) Notice: Subject to any disclaimer, the term of this patent is extended or adjusted under 35 U.S.C. 154(b) by 0 days.

(21) Appl. No.: 16/972,580

(22) PCT Filed: Jun. 5, 2019

(86) PCT No.: PCT/EP2019/064614
§ 371 (c)(1),
(2) Date: Dec. 5, 2020

(87) PCT Pub. No.: WO2019/234083
PCT Pub. Date: Dec. 12, 2019

(65) Prior Publication Data

US 2021/0245119 A1 Aug. 12, 2021

Related U.S. Application Data

(63) Continuation of application No. PCT/EP2018/064939, filed on Jun. 6, 2018.

(30) Foreign Application Priority Data

Aug. 3, 2018 (DE) ..... 10 2018 118 957.5

(51) Int. Cl.
*B01F 5/02* (2006.01)
*B01F 15/06* (2006.01)
(Continued)

(52) U.S. Cl.
CPC ..... *B01F 35/522* (2022.01); *B01F 25/4321* (2022.01); *B01F 25/43161* (2022.01);
(Continued)

(58) Field of Classification Search
CPC ..... B01F 35/522; B01F 25/43161; B01F 25/4321; B01F 33/50111; B01F 35/513;
(Continued)

(56) References Cited

U.S. PATENT DOCUMENTS 3,159,312 A * 12/1964 Sciver, II ..... B05C 17/00553 222/326
5,080,493 A * 1/1992 McKown ..... B01F 25/43141 222/459
(Continued)

FOREIGN PATENT DOCUMENTS

DE 10322922 A1 12/2004
EP 0121342 A2 10/1984
WO 1992/22494 A1 12/1992

OTHER PUBLICATIONS

International Search Report for corresponding PCT/EP2019/064614, filed Jun. 5, 2 019.
(Continued)

*Primary Examiner* — Frederick C Nicolas
(74) *Attorney, Agent, or Firm* — ProPat, LLC; Cathy R. Moore

(57) ABSTRACT

The present invention relates to a dispenser for viscous materials that includes a static mixer, a first and second receptacle $R_1$ and $R_2$ for a first and second viscous material, connected in fluid communication with the static mixer, a first and second actuator configured for discharge of receptacle $R_1$ and $R_2$, an electrically or manually operable drive
(Continued)

and a mechanical or hydraulic power transmission configured to translate drive motion into first and second actuator motion.

13 Claims, 14 Drawing Sheets

(51) Int. Cl.

| | |
|---|---|
| ***B65D 81/32*** | (2006.01) |
| ***B01F 35/52*** | (2022.01) |
| ***B01F 25/432*** | (2022.01) |
| ***B01F 25/431*** | (2022.01) |
| ***B01F 33/501*** | (2022.01) |
| ***B01F 35/513*** | (2022.01) |
| ***B01F 35/00*** | (2022.01) |
| ***B01F 35/71*** | (2022.01) |
| *B01F 35/30* | (2022.01) |

(52) U.S. Cl.
CPC ..... *B01F 33/50111* (2022.01); *B01F 35/513* (2022.01); *B01F 35/561* (2022.01); *B01F 35/7131* (2022.01); *B01F 35/7174* (2022.01); *B01F 35/71795* (2022.01); *B01F 35/71805* (2022.01); *B65D 81/3233* (2013.01); *B65D 81/3261* (2013.01); *B01F 25/43163* (2022.01); *B01F 25/431971* (2022.01); *B01F 25/431972* (2022.01); *B01F 2035/351* (2022.01)

(58) Field of Classification Search
CPC ..... B01F 35/561; B01F 35/7131; B01F 35/7174; B01F 35/71795; B01F 35/71805; B01F 25/43163; B01F 25/431971; B01F 25/431972; B01F 2035/351; B65D 81/3233; B65D 81/3261
See application file for complete search history.

(56) References Cited

U.S. PATENT DOCUMENTS 5,166,301 A 11/1992 Jacobs
5,203,839 A * 4/1993 Skaggs ..... B05C 17/00553 222/137
5,263,614 A * 11/1993 Jacobsen ..... B05C 17/01 222/391
5,390,825 A 2/1995 Rockel
5,477,987 A * 12/1995 Keller ..... B05C 17/00513 222/326
5,851,067 A * 12/1998 Fleischli ..... B01F 25/4321 366/337
6,019,251 A 2/2000 Koga
6,168,052 B1 * 1/2001 Keller ..... B05C 17/0103 222/333
6,315,164 B1 * 11/2001 Muhlbauer ..... B05C 17/0103 366/177.1
6,386,396 B1 * 5/2002 Strecker ..... G01F 13/005 222/413
6,932,237 B2 * 8/2005 Heymann ..... B05C 17/00553 222/326
8,579,497 B2 * 11/2013 Harre ..... B01F 27/092 366/331
8,631,973 B2 * 1/2014 Grundler ..... A61C 5/64 222/137
2002/0104851 A1 * 8/2002 Parise ..... B29C 48/12 222/137
2010/0252574 A1 * 10/2010 Busin ..... A61C 9/0026 222/137
2012/0258420 A1 * 10/2012 Boehm ..... A61C 9/0026 141/2
2013/0037570 A1 * 2/2013 Broyles ..... A61C 5/68 222/137
2013/0135963 A1 5/2013 Linne et al.
2013/0175290 A1 * 7/2013 Vogt ..... B05C 17/00566 222/137
2013/0181008 A1 * 7/2013 Vogt ..... B05C 17/00556 222/137
2014/0158711 A1 * 6/2014 Peuker ..... B65B 1/04 222/137
2014/0197204 A1 * 7/2014 Bublewitz ..... B05C 17/00513 222/137
2020/0164323 A1 * 5/2020 Müller ..... B65D 81/3233

OTHER PUBLICATIONS

Written Opinion of the ISA for corresponding PCT/EP2019/064614, filed Jun. 5, 2019.

* cited by examiner

DISPENSER FOR VISCOUS MATERIALS

CROSS-REFERENCE TO RELATED APPLICATIONS

This application is being filed under 35 U.S.C. § 371 as a National Stage Application of pending International Application No. PCT/EP2019/064614 filed Jun. 5, 2019, which claims priority to the following parent applications: International Application No. PCT/EP2018/064939, filed Jun. 6, 2018 and German Patent Application No. 10 2018 118 957.5, filed Aug. 3, 2018. International Application No. PCT/EP2019/064614, International Application No. PCT/EP2018/064939 and German Patent Application No. 10 2018 118 957.5 are hereby incorporated by reference herein in their entirety.

FIELD OF THE INVENTION

The present invention pertains to a dispenser, comprising a static mixer; a first and second receptacle $R_1$ and $R_2$ for a first and, respectively second viscous material, each receptacle $R_1$ and $R_2$ connected in fluid communication with the static mixer; a first and second actuator movable into and out of receptacle $R_1$ and, respectively $R_2$; an electrically or manually operable drive; and at least one mechanical or hydraulic power transmission configured to translate drive motion into first and second actuator motion.

BACKGROUND OF THE INVENTION

Dispensing devices for multi-component viscous materials are known in the art.

U.S. Pat. No. 5,390,825 A discloses a self-contained device for dispensing two-part adhesive comprising a cart, first and second cartridge holders on the cart, each holder having an adhesive dispensing outlet and a seal-piercing die at the lower end, and an opening at the upper end for receiving a pre-filled adhesive cartridge sealed at its discharge end. A plunger assembly having first and second plunger is mounted at the cartridge receiving openings of the cartridge holders. The plungers are operatively connected to a hydraulic cylinder so that the plungers and hydraulic cylinder move in unison. The plunger assembly is pivotable from locked to unlocked position to permit loading and unloading of pre-filled cartridges. Each plunger has an expandable plunger cup which engages the adhesive component in the associated cartridge as the plunger moves downwardly in the cartridge, thereby forcing the adhesive and seal against the die to rupture the seal and discharge the adhesive component through the dispensing outlet. The hydraulic cylinder is operatively connected to a hydraulic pump which is powered by a self-contained power source.

WO 1992/22494 describes a portable apparatus for dispensing adhesive materials from cartridge type containers using axially directed plungers which are driven by a manually operated hydraulic pump supplying pressurized fluid to a hydraulic cylinder. The output of the hydraulic cylinder is coupled to a pair of plungers that engage the cartridges to force the adhesive materials out through a mixing nozzle.

U.S. Pat. No. 6,019,251 A pertains to an extrusion device comprising an actuator plate hinged pivotably on a base plate. Two tubes containing two-part reactive curing materials are interposed between the base and actuator plate. The actuator plate is pivoted downward to squeeze both tubes and simultaneously extrude both materials when a grip arranged on a bottom face of the base plate is held and a lever positioned in front of the grip is pulled. The extrusion device comprises a coater a nozzle B connected to both tubes through which both materials which are jointly discharged.

SUMMARY OF ADVANTAGEOUS EMBODIMENTS OF THE INVENTION

The dispenser of the present invention is intended for use with disposable containers containing given volumes of two viscous materials, such as two-component RTV silicones, which must be thoroughly mixed at the point of use prior to application onto a substrate or deposition into a mold.

The disposable containers to be used in the inventive dispenser essentially consist of a compartmentalized pouch comprising a flexible sleeve made of polymeric film and two therein contained viscous materials. Advantageously, each of the viscous materials is enclosed in an auxiliary interior casing that prevents migration and chemical reaction between volatile components inside the disposable container. Preferably, the auxiliary interior casings are made from polymeric film having barrier properties. The sleeve of the disposable container encloses the viscous materials and shields the dispenser against contact therewith during dispense operation. If the container sleeve is breached parts of the dispenser may be wetted with viscous material which upon curing strongly adheres to the dispenser and is difficult to remove or renders the dispenser unusable for further dispense operation. In the framework of the present invention dispense operation without contact between the dispensed materials and the dispenser is designated as "contactless dispensing".

The present invention has the object to provide a dispenser that enables contactless dispensing of thoroughly mixed viscous two-component materials from a pouch-like disposable container with flexible sleeve.

DETAILED DESCRIPTION OF ADVANTAGEOUS INVENTIVE EMBODIMENTS

Figure 1:
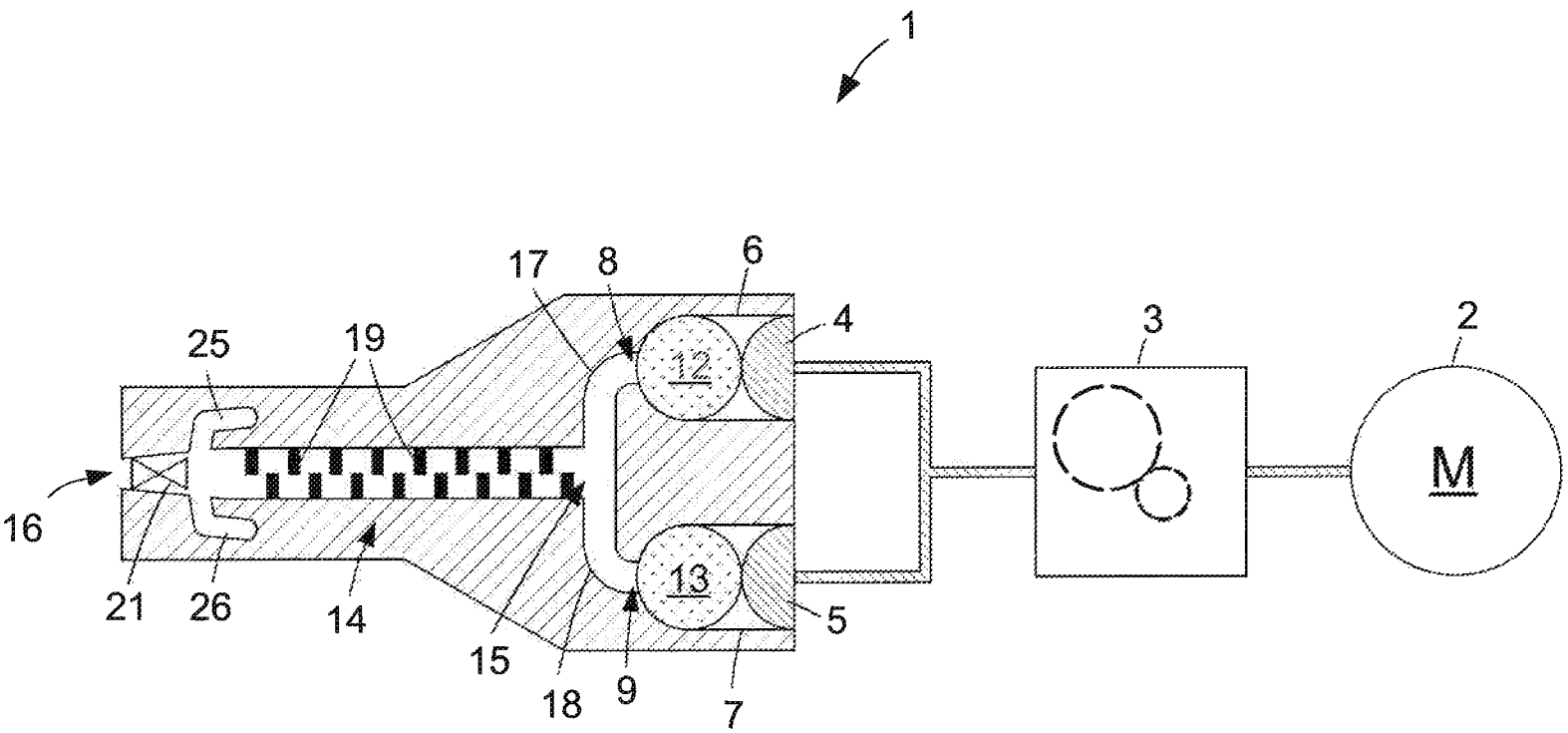
FIG. 1 is a schematic illustration of an exemplary cross-section of a dispenser comprising two receptacles for viscous materials and an integral static mixer.

This object is achieved through a dispenser comprising a static mixer;

a first and second receptacle $R_1$ and $R_2$ for a first and, respectively second viscous material, each receptacle $R_1$ and $R_2$ connected in fluid communication with the static mixer;

a first and second actuator configured for discharge of receptacle $R_1$ and, respectively $R_2$;

an electrically or manually operable drive; and at least one mechanical or hydraulic power transmission configured to translate drive motion into first and second actuator motion.

Expedient embodiments of the inventive dispenser are characterized in that the dispenser is configured for discharge of the first and second receptacle $R_1$, $R_2$ at a relative volumetric rate i.e. discharge volume per time ratio of 1:1 to 12:1;

the dispenser is configured for discharge of the first and second receptacle $R_1$, $R_2$ at a relative volumetric rate ratio of 1:1 to 5:1, 3:1 to 7:1, 5:1 to 9:1 or 9:1 to 12:1;

the dispenser is configured for discharge of the first and second receptacle $R_1$, $R_2$ at a relative volumetric rate ratio of 1.0:1.0 to 1.1:1.0;

the dispenser comprises a frame and a lid;

the frame and lid are mechanically coupled through a hinge;

the dispenser comprises a lock for attaching the lid to the frame in a form-fit manner;

the dispenser comprises a lock for attaching the lid to the frame in a force-fit manner;

the dispenser is configured to accommodate a disposable container comprising a sleeve, a reservoir for two viscous materials and a mixing tube;

the dispenser is configured to accommodate a disposable container comprising a sleeve, a reservoir for two viscous materials, a mixing tube and a carrier sheet with one aperture arranged within the mixing tube;

the dispenser is configured to accommodate a disposable container comprising a sleeve, a reservoir for two viscous materials, a mixing tube and a carrier sheet with m apertures arranged within the mixing tube with $8 \leq m \leq 120$;

the dispenser is configured to accommodate a disposable container comprising a sleeve, a reservoir for two viscous materials, a mixing tube and a carrier sheet with m apertures arranged within the mixing tube with $8 \leq m \leq 24$, $16 \leq m \leq 32$, $24 \leq m \leq 40$, $32 \leq m \leq 48$, $40 \leq m \leq 56$, $48 \leq m \leq 64$, $56 \leq m \leq 72$, $64 \leq m \leq 80$, $72 \leq m \leq 88$, $80 \leq m \leq 96$, $88 \leq m \leq 104$, $96 \leq m \leq 112$ or $104 \leq m \leq 120$;

the dispenser is configured to accommodate a disposable container comprising a sleeve, a reservoir for two viscous materials and a mixing tube that contains a shield with m apertures with $8 \leq m \leq 120$;

the dispenser is configured to accommodate a disposable container comprising a sleeve, a reservoir for two viscous materials and a mixing tube that contains a shield with m apertures with $8 \leq m \leq 24$, $16 \leq m \leq 32$, $24 \leq m \leq 40$, $32 \leq m \leq 48$, $40 \leq m \leq 56$, $48 \leq m \leq 64$, $56 \leq m \leq 72$, $64 \leq m \leq 80$, $72 \leq m \leq 88$, $80 \leq m \leq 96$, $88 \leq m \leq 104$, $96 \leq m \leq 112$ or $104 \leq m \leq 120$;

the dispenser comprises a frame, a lid and a gasket configured for interposition between the frame and lid;

the gasket is made from a sheet consisting of an elastic material;

the gasket is made from a sheet consisting of an elastic material selected from the group comprising natural rubber, synthetic rubber, polymers and mixtures thereof;

the gasket is made from a composite sheet material comprising a fabric or filaments made from a polymeric or metallic material;

the gasket is affixed to the frame;

the gasket is affixed to the lid;

the gasket comprises a cut-out for the static mixer;

the gasket comprises a cut-out for the mixing section of the static mixer;

the gasket comprises a cut-out for each the first and second receptacle $R_1$, $R_2$;

the gasket comprises three or more cut-outs;

the gasket comprises a first and second diaphragm for discharge of the first and, respectively second receptacle $R_1$, $R_2$;

the gasket comprises a first and second diaphragm which each form an integral part of the gasket;

each the first and second actuator comprise a first and, respectively second diaphragm which form integral parts of the gasket;

the static mixer comprises n deflectors with $8 \leq n \leq 120$;

the static mixer comprises n deflectors with $8 \leq n \leq 24$, $16 \leq n \leq 32$, $24 \leq n \leq 40$, $32 \leq n \leq 48$, $40 \leq n \leq 56$, $48 \leq n \leq 64$, $56 \leq n \leq 72$, $64 \leq n \leq 80$, $72 \leq n \leq 88$, $80 \leq n \leq 96$, $88 \leq n \leq 104$, $96 \leq n \leq 112$ or $104 \leq n \leq 120$;

each deflector has rounded or beveled edges;

the static mixer is configured to accommodate a mixing tube and part of a carrier sheet of a disposable container, the carrier sheet comprising one aperture and having a thickness of 0.3 to 3.0 mm, 0.3 to 2.0 mm, 0.3 to 1.0 mm or 0.3 to 0.8 mm;

the static mixer is configured to accommodate a mixing tube and part of a carrier sheet of a disposable container, the carrier sheet comprising m apertures and having a thickness of 0.3 to 3.0 mm, 0.3 to 2.0 mm, 0.3 to 1.0 mm or 0.3 to 0.8 mm;

the static mixer is configured to accommodate a mixing tube and a shield of a disposable container, the shield comprising m apertures and having a thickness of 0.3 to 3.0 mm, 0.3 to 2.0 mm, 0.3 to 1.0 mm or 0.3 to 0.8 mm;

the static mixer comprises an inlet, a mixing section and an outlet and the mixing section is arranged between the inlet and outlet;

the static mixer comprises an inlet section, a mixing section and an outlet section and the mixing section is arranged between the inlet section and the outlet section;

the static mixer comprises a mixing section configured as straight duct or flow passage having a contoured inner surface with protrusions;

the static mixer comprises a mixing section configured as straight duct or flow passage having a contoured inner surface comprising deflectors;

the static mixer comprises a mixing section configured as curved duct or flow passage having a contoured inner surface with protrusions;

the static mixer comprises a mixing section configured as curved duct or flow passage having a contoured inner surface comprising deflectors;

the static mixer comprises a mixing section having an inner surface with a shape corresponding to a union of a lateral-surface of a cylindrical body with elliptical cross-section and the surfaces of n deflectors with $8 \leq n \leq 120$ arranged along a principal axis of the cylindrical body and a major axis of the elliptical cross-section is larger by a factor of 1.2 to 4.0 than the minor axis of the elliptical cross-section;

the static mixer comprises a mixing section that bounds a flow passage comprised of four meander-shaped interconnected ducts;

the static mixer comprises a mixing section that bounds a flow passage comprised of four meander-shaped interconnected and partly overlayed ducts;

the static mixer is arranged between the first and second receptacle $R_1$ and $R_2$;

the static mixer forms an integral part of the dispenser;

the static mixer comprises a first and second die configured for reversible insertion into the dispenser;

the dispenser comprises a first and second socket for reversible insertion of a first and, respectively second static mixer die;

the dispenser comprises a first and second socket for reversible force-fit insertion of a first and, respectively second static mixer die;

the frame comprises a socket for reversible insertion of a first static mixer die;

the frame comprises a socket for reversible force-fit insertion of a first static mixer die;

the lid comprises a socket for reversible insertion of a second static mixer die;

the lid comprises a socket for reversible force-fit insertion of a second static mixer die;

the static mixer comprises a first and second channel;

the static mixer comprises a first channel arranged in the frame;

the static mixer comprises a first channel that is arranged in the frame and forms an integral part of the frame;

the static mixer comprises a second channel arranged in the lid;

the static mixer comprises a second channel that is arranged in the lid and forms an integral part of the lid;

the first channel comprises an inlet section, a mixing section and an outlet section and the mixing section is arranged between the inlet and outlet section;

the mixing section of the first channel has an inner surface with a shape corresponding to a union of a half-lateral-surface of a cylindrical body with rectangular, polygonal, spherical or elliptical cross-section and the surfaces of p deflectors with $4 \leq p \leq 60$ arranged along a principal axis of the cylindrical body;

the mixing section of the first channel has an inner surface with a shape corresponding to a union of a half-lateral-surface of a cylindrical body with rectangular, polygonal, spherical or elliptical cross-section and the surfaces of p deflectors with $4 \leq p \leq 60$ arranged along a principal axis of the cylindrical body and the cylindrical body has a first diameter along a first axis and a second diameter along a second axis and the first and second axis are perpendicular to each other and the principal axis;

the mixing section of the first channel has an inner surface with a shape corresponding to a union of a half-lateral-surface of a cylindrical body with elliptical cross-section and the surfaces of p deflectors with $4 \leq p \leq 60$ arranged along a principal axis of the cylindrical body and a major axis of the elliptical cross-section is larger by a factor of 1.1 to 4.0 than the minor axis of the elliptical cross-section;

the mixing section of the first channel has an inner surface with a shape corresponding to a union of a half-lateral-surface of a cylindrical body with elliptical cross-section and the surfaces of p deflectors with $4 \leq p \leq 60$ arranged along a principal axis of the cylindrical body and a major axis of the elliptical cross-section is larger by a factor of 1.1 to 1.6, 1.4 to 1.8, 1.6 to 2.0, 1.8 to 2.2, 2.0 to 2.4, 2.2 to 2.6, 2.4 to 2.8, 2.6 to 3.0, 2.8 to 3.2, 3.0 to 3.4, 3.2 to 3.6, 3.4 to 3.8 or 3.6 to 4.0 than the minor axis of the elliptical cross-section;

the mixing section of the first channel has an inner surface with a shape corresponding to a union of a half-lateral-surface of a cylindrical body with rectangular, polygonal, spherical or elliptical cross-section and the surfaces of p deflectors with $4 \leq p \leq 60$ arranged equidistantly along a principal axis of the cylindrical body;

the mixing section of the first channel has an inner surface with a shape corresponding to a union of a half-lateral-surface of a cylindrical body with rectangular, polygonal, spherical or elliptical cross-section and the surfaces of p deflectors with $4 \leq p \leq 60$ arranged along a principal axis of the cylindrical body in a manner corresponding to the teeth of two interdigitate facing combs;

$4 \leq p \leq 12$, $8 \leq p \leq 16$, $12 \leq p \leq 20$, $16 \leq p \leq 24$, $20 \leq p \leq 28$, $24 \leq p \leq 32$, $28 \leq p \leq 36$, $32 \leq p \leq 40$, $36 \leq p \leq 44$, $40 \leq p \leq 48$, $44 \leq p \leq 52$, $48 \leq p \leq 56$ or $52 \leq p \leq 60$;

each deflector surface of the first channel intersects the principal axis of the mixing section of the first channel;

each deflector surface of the first channel protrudes from the half-lateral-surface of the cylindrical body by a distance of 40% to 80% of a first diameter of the cylindrical body;

each deflector surface of the first channel protrudes from the half-lateral-surface of the cylindrical body by a distance of 45% to 80% of a first diameter of the cylindrical body;

each deflector surface of the first channel protrudes from the half-lateral-surface of the cylindrical body by a distance of 45% to 55% of a first diameter of the cylindrical body;

each deflector surface of the first channel protrudes from the half-lateral-surface of the cylindrical body by a distance of 40% to 80% of a second diameter of the cylindrical body;

each deflector surface of the first channel protrudes from the half-lateral-surface of the cylindrical body by a distance of 45% to 80% of a second diameter of the cylindrical body;

each deflector surface of the first channel protrudes from the half-lateral-surface of the cylindrical body by a distance of 45% to 55% of a second diameter of the cylindrical body;

the second channel comprises an inlet section, a mixing section and an outlet section and the mixing section is arranged between the inlet and outlet section;

the mixing section of the second channel has an inner surface with a shape corresponding to a union of a half-lateral-surface of a cylindrical body with rectangular, polygonal, spherical or elliptical cross-section and the surfaces of q deflectors with $4 \leq q \leq 60$ arranged along a principal axis of the cylindrical body;

the mixing section of the second channel has an inner surface with a shape corresponding to a union of a half-lateral-surface of a cylindrical body with rectangular, polygonal, spherical or elliptical cross-section and the surfaces of q deflectors with $4 \leq q \leq 60$ arranged along a principal axis of the cylindrical body and the cylindrical body has a first diameter along a first axis and a second diameter along a second axis and the first and second axis are perpendicular to each other and the principal axis;

the mixing section of the second channel has an inner surface with a shape corresponding to a union of a half-lateral-surface of a cylindrical body with elliptical cross-section and the surfaces of q deflectors with $4 \leq q \leq 60$ arranged along a principal axis of the cylindrical body and a major axis of the elliptical cross-section is larger by a factor of 1.1 to 4.0 than the minor axis of the elliptical cross-section;

the mixing section of the second channel has an inner surface with a shape corresponding to a union of a half-lateral-surface of a cylindrical body with elliptical cross-section and the surfaces of q deflectors with $4 \leq q \leq 60$ arranged along a principal axis of the cylindrical body and a major axis of the elliptical cross-section is larger by a factor of 1.1 to 1.6, 1.4 to 1.8, 1.6 to 2.0, 1.8 to 2.2, 2.0 to 2.4, 2.2 to 2.6, 2.4 to 2.8, 2.6 to 3.0, 2.8 to 3.2, 3.0 to 3.4, 3.2 to 3.6, 3.4 to 3.8 or 3.6 to 4.0 than the minor axis of the elliptical cross-section;

the mixing section of the second channel has an inner surface with a shape corresponding to a union of a half-lateral-surface of a cylindrical body with rectangular, polygonal, spherical or elliptical cross-section and the surfaces of q deflectors with $4 \leq q \leq 60$ arranged equidistantly along a principal axis of the cylindrical body;

the mixing section of the second channel has an inner surface with a shape corresponding to a union of a half-lateral-surface of a cylindrical body with rectangular, polygonal, spherical or elliptical cross-section and the surfaces of q deflectors with $4 \leq q \leq 60$ arranged along a principal axis of the cylindrical body in a manner corresponding to the teeth of two interdigitate facing combs;

$4 \leq q \leq 12$, $8 \leq q \leq 16$, $12 \leq q \leq 20$, $16 \leq q \leq 24$, $20 \leq q \leq 28$, $24 \leq q \leq 32$, $28 \leq q \leq 36$, $32 \leq q \leq 40$, $36 \leq q \leq 44$, $40 \leq q \leq 48$, $44 \leq q \leq 52$, $48 \leq q \leq 56$ or $52 \leq q \leq 60$;

each deflector surface of the second channel intersects the principal axis of the mixing section of the second channel;

each deflector surface of the second channel protrudes from the half-lateral-surface of the cylindrical body by a distance of 40% to 80% of a first diameter of the cylindrical body;

each deflector surface of the second channel protrudes from the half-lateral-surface of the cylindrical body by a distance of 45% to 80% of a first diameter of the cylindrical body;

each deflector surface of the second channel protrudes from the half-lateral-surface of the cylindrical body by a distance of 45% to 55% of a first diameter of the cylindrical body;

each deflector surface of the second channel protrudes from the half-lateral-surface of the cylindrical body by a distance of 40% to 80% of a second diameter of the cylindrical body;

each deflector surface of the second channel protrudes from the half-lateral-surface of the cylindrical body by a distance of 45% to 80% of a second diameter of the cylindrical body;

each deflector surface of the second channel protrudes from the half-lateral-surface of the cylindrical body by a distance of 45% to 55% of a second diameter of the cylindrical body;

the inner surface of the mixing section of the first channel has a shape that corresponds to the inner surface of a meandering groove;

the inner surface of the mixing section of the second channel has a shape that corresponds to the inner surface of a meandering groove;

the dispenser is configured for juxtaposition of the first and second channel of the static mixer;

in form-fit attachment of the lid to the frame the first and second channel of the static mixer are arranged in facing position;

in form-fit attachment of the lid to the frame the principal axes of the mixing sections of the first and second channel of the static mixer are collinear;

the inner surface of the mixing sections of the first and second channel each correspond to the inner surface of a first and, respectively second meandering groove and are shaped in such manner that in form-fit attachment of the lid to the frame the inner surface of the mixing section of the first channel is congruent to the inner surface of the mixing section of the second channel when mirrored along two axes that are perpendicular to each other and the principal axis of the mixing section of the first channel;

the inner surface of the mixing sections of the first and second channel each correspond to the inner surface of a first and, respectively second meandering groove and are shaped in such manner that in form-fit attachment of the lid to the frame the inner surface of the mixing section of the first channel is congruent to the inner surface of the mixing section of the second channel when rotated by 180 degree around the principal axis of the mixing section of the first channel;

the inner surface of the mixing sections of the first and second channel each correspond to the inner surface of a first and, respectively second meandering groove and are shaped in such manner that in form-fit attachment of the lid to the frame the inner surface of the mixing section of the second channel is congruent to the inner surface of the mixing section of the first channel when mirrored along two axes that are perpendicular to each other and the principal axis of the mixing section of the second channel;

the inner surface of the mixing sections of the first and second channel each correspond to the inner surface of a first and, respectively second meandering groove and are shaped in such manner that in form-fit attachment of the lid to the frame the inner surface of the mixing section of the second channel is congruent to the inner surface of the mixing section of the first channel when rotated by 180 degree around the principal axis of the mixing section of the second channel;

the first and second receptacle $R_1$ and $R_2$ are each configured as cavity;

the first and second receptacle $R_1$ and $R_2$ each comprise an outlet connected in fluid communication with the static mixer;

the static mixer comprises an inlet and the first and second receptacle $R_1$ and $R_2$ each comprise an outlet connected in fluid communication with the static mixer through a first and, respectively second duct;

the static mixer comprises an inlet and the first and second receptacle $R_1$ and $R_2$ each comprise an outlet connected in fluid communication with the inlet of the static mixer;

the static mixer comprises an inlet and the first and second receptacle $R_1$ and $R_2$ each comprise an outlet connected in fluid communication with the inlet of the static mixer through a first and, respectively second duct;

receptacle $R_1$ and/or receptacle $R_2$ is arranged in the frame;

receptacle $R_1$ and/or receptacle $R_2$ is arranged in the lid;

receptacle $R_1$ comprises a first and second part arranged in the frame and, respectively in the lid;

receptacle $R_2$ comprises a first and second part arranged in the frame and, respectively in the lid;

in form-fit attachment of the lid to the frame the first and second channel of the static mixer are arranged between receptacle $R_1$ and $R_2$;

the first and second receptacle $R_1$ and $R_2$ are each configured as elongate cavity;

the first and second receptacle $R_1$ and $R_2$ are each configured as cavity having a first and, respectively second principal axis along which $R_1$ and $R_2$ have a maximal spatial extent;

the first and second receptacle $R_1$ and $R_2$ are each configured as cavity having a first and, respectively second principal axis along which $R_1$ and $R_2$ have a maximal spatial extent;

a first and second average cross section $A_1$ and, respectively $A_2$ in a first and second plane perpendicular to the first and second principal axis;

wherein the extent of $R_1$ and $R_2$ along the first and second principal axis is larger by factor of from 1.4 to 20, 1.4 to 15, 1.4 to 10 or 1.4 to 5 than $\sqrt{A_1/\pi}$ and $\sqrt{A_2/\pi}$, respectively;

in form-fit attachment of the lid to the frame the principal axes of the mixing section of the first and second channel of the static mixer are collinear to the principal axes of receptacle $R_1$ and $R_2$;

the first and second actuator are movable collinearly to the principal axis of the first and, respectively second receptacle $R_1$, $R_2$;

the first and second actuator are configured for translation collinearly to the principal axis of the first and, respectively second receptacle $R_1$, $R_2$;

the first and second actuator are movable in a direction perpendicular to the principal axis of the first and, respectively second receptacle $R_1$, $R_2$;

the first and second actuator are configured for translation in a direction perpendicular to the principal axis of the first and, respectively second receptacle $R_1$, $R_2$;

the first and second actuator are expandable and retractable in a direction perpendicular to the principal axis of the first and, respectively second receptacle $R_1$, $R_2$;

the first and second actuator are configured for expansion and retraction in a direction perpendicular to the principal axis of the first and, respectively second receptacle $R_1$, $R_2$;

the first receptacle $R_1$ has a capacity $V_1$ of 2 to 10000 ml;

the first receptacle $R_1$ has a capacity $V_1$ of 2 to 15 ml, 10 to 20 ml, 15 to 25 ml, 20 to 30 ml, 25 to 35 ml, 30 to 40 ml, 35 to 45 ml, 40 to 50 ml, 45 to 55 ml, 50 to 60 ml, 55 to 65 ml, 60 to 70 ml, 65 to 75 ml, 70 to 80 ml, 75 to 85 ml, 80 to 90 ml, 85 to 95 ml, 90 to 100 ml, 100 to 300 ml, 200 to 400 ml, 300 to 500 ml, 400 to 600 ml, 500 to 700 ml, 600 to 800 ml, 700 to 900 ml, 800 to 1000 ml, 1000 to 3000 ml, 2000 to 4000 ml, 3000 to 5000 ml, 4000 to 6000 ml, 5000 to 7000 ml, 6000 to 8000 ml, 7000 to 9000 ml or 8000 to 10000 ml;

the second receptacle $R_2$ has a capacity $V_2$ of 2 to 10000 ml;

the second receptacle $R_2$ has a capacity $V_2$ of 2 to 15 ml, 10 to 20 ml, 15 to 25 ml, 20 to 30 ml, 25 to 35 ml, 30 to 40 ml, 35 to 45 ml, 40 to 50 ml, 45 to 55 ml, 50 to 60 ml, 55 to 65 ml, 60 to 70 ml, 65 to 75 ml, 70 to 80 ml, 75 to 85 ml, 80 to 90 ml, 85 to 95 ml, 90 to 100 ml, 100 to 300 ml, 200 to 400 ml, 300 to 500 ml, 400 to 600 ml, 500 to 700 ml, 600 to 800 ml, 700 to 900 ml, 800 to 1000 ml, 1000 to 3000 ml, 2000 to 4000 ml, 3000 to 5000 ml, 4000 to 6000 ml, 5000 to 7000 ml, 6000 to 8000 ml, 7000 to 9000 ml or 8000 to 10000 ml;

the first and second receptacle $R_1$, $R_2$ have a first capacity $V_1$ and, respectively second capacity $V_2$ with $1 \leq V_1/V_2 \leq 12$;

the first and second receptacle $R_1$, $R_2$ have a first capacity $V_1$ and, respectively second capacity $V_2$ with $1 \leq V_1/V_2 \leq 3$, $2 \leq V_1/V_2 \leq 4$, $3 \leq V_1/V_2 \leq 5$, $4 \leq V_1/V_2 \leq 6$, $5 \leq V_1/V_2 \leq 7$, $6 \leq V_1/V_2 \leq 8$, $7 \leq V_1/V_2 \leq 9$, $8 \leq V_1/V_2 \leq 10$, $9 \leq V_1/V_2 \leq 11$ or $10 \leq V_1/V_2 \leq 12$;

the first receptacle $R_1$ has an inner surface $S_1$ with a terminal section corresponding to a union of a half-lateral-surface of a cylindrical body with polygonal, rectangular, elliptical or circular cross-section with equivalent diameter $D_1$ and length $L_1$ along a principal axis perpendicular to the cross-section and the surfaces of a first and second half-dome arranged at the cylindrical body front ends;

the second receptacle $R_2$ has an inner surface $S_2$ with a terminal section corresponding to a union of a half-lateral-surface of a cylindrical body with polygonal, rectangular, elliptical or circular cross-section with equivalent diameter $D_2$ and length $L_2$ along a principal axis perpendicular to the cross-section and the surfaces of a first and second half-dome arranged at the cylindrical body front ends;

the first receptacle $R_1$ has an inner surface $S_1$ corresponding to a union of a lateral-surface of a cylindrical body with polygonal, rectangular, elliptical or circular cross-section with equivalent diameter $D_1$ and length $L_1$ along a principal axis perpendicular to the cross-section and the surfaces of a first and second dome arranged at the cylindrical body front ends;

the second receptacle $R_2$ has an inner surface $S_2$ corresponding to a union of a lateral-surface of a cylindrical body with polygonal, rectangular, elliptical or circular cross-section with equivalent diameter $D_2$ and length $L_2$ along a principal axis perpendicular to the cross-section and the surfaces of a first and second dome arranged at the cylindrical body front ends;

$2 \leq L_1/D_1 \leq 12$ and $2 \leq L_2/D_2 \leq 12$;

$2 \leq L_1/D_1 \leq 4$ and $2 \leq L_2/D_2 \leq 4$;

$3 \leq L_1/D_1 \leq 5$ and $3 \leq L_2/D_2 \leq 5$;

$4 \leq L_1/D_1 \leq 6$ and $4 \leq L_2/D_2 \leq 6$;

$5 \leq L_1/D_1 \leq 7$ and $5 \leq L_2/D_2 \leq 7$;

$6 \leq L_1/D_1 \leq 8$ and $6 \leq L_2/D_2 \leq 8$;

$7 \leq L_1/D_1 \leq 9$ and $7 \leq L_2/D_2 \leq 9$;

$8 \leq L_1/D_1 \leq 10$ and $8 \leq L_2/D_2 \leq 10$;

$9 \leq L_1/D_1 \leq 11$ and $9 \leq L_2/D_2 \leq 11$;

$10 \leq L_1/D_1 \leq 12$ and $10 \leq L_2/D_2 \leq 12$;

in form-fit attachment of the lid to the frame the principal axes of the mixing section of the first and second channel of the static mixer are collinear to the principal axes of receptacle $R_1$ and $R_2$;

the first and second actuator are movable in a direction perpendicular to the principal axis of the first and, respectively second receptacle $R_1$, $R_2$;

the first and second actuator are configured for translation in a direction perpendicular to the principal axis of the first and, respectively second receptacle $R_1$, $R_2$;

the first and second actuator are expandable and retractable in a direction perpendicular to the principal axis of the first and, respectively second receptacle $R_1$, $R_2$;

the first and second actuator are configured for expansion and retraction in a direction perpendicular to the principal axis of the first and, respectively second receptacle $R_1$, $R_2$;

the first actuator has an operative surface $F_1$ with a shape corresponding to a union of a half-lateral-surface of a cylindrical body with polygonal, rectangular, elliptical or circular cross-section and the surfaces of a first and second half-dome arranged at the cylindrical body front ends;

the second actuator has an operative surface $F_2$ with a shape corresponding to a union of a half-lateral-surface of a cylindrical body with polygonal, rectangular, elliptical or circular cross-section and the surfaces of a first and second half-dome arranged at the cylindrical body front ends;

the first actuator has an operative surface $F_1$ with shape corresponding to a union of a half-lateral-surface of a cylindrical body with polygonal, rectangular, elliptical or circular cross-section with equivalent diameter from $0.8 \cdot D_1$ to $D_1$ and a length from $0.8 \cdot L_1$ to $L_1$ along a principal axis perpendicular to the cross-section and the surfaces of a first and second half-dome arranged at the cylindrical body front ends;

the second actuator has an operative surface $F_2$ with shape corresponding to a union of a half-lateral-surface of a cylindrical body with polygonal, rectangular, elliptical or circular cross-section with equivalent diameter from $0.8 \cdot D_2$ to $D_2$ and a length from $0.8 \cdot L_2$ to $L_2$ along a principal axis perpendicular to the cross-section and the surfaces of a first and second half-dome arranged at the cylindrical body front ends;

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le 1,3 \cdot \frac{\pi}{2}D_1(L_1 + D_1) \text{ and } 0,$$
$$8 \cdot D_2\left(L_2 + \frac{\pi}{4}D_2\right) \le F_2 \le 1,3 \cdot \frac{\pi}{2}D_2(L_2 + D_2);$$

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le 1,2 \cdot \frac{\pi}{2}D_1(L_1 + D_1) \text{ and } 0,$$
$$8 \cdot D_2\left(L_2 + \frac{\pi}{4}D_2\right) \le F_2 \le 1,2 \cdot \frac{\pi}{2}D_2(L_2 + D_2);$$

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le 1,1 \cdot \frac{\pi}{2}D_1(L_1 + D_1) \text{ and } 0,$$
$$8 \cdot D_2\left(L_2 + \frac{\pi}{4}D_2\right) \le F_2 \le 1,1 \cdot \frac{\pi}{2}D_2(L_2 + D_2);$$

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le \frac{\pi}{2}D_1(L_1 + D_1) \text{ and } 0,$$
$$8 \cdot D_2\left(L_2 + \frac{\pi}{4}D_2\right) \le F_2 \le \frac{\pi}{2}D_2(L_2 + D_2);$$

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le 0,9 \cdot \frac{\pi}{2}D_1(L_1 + D_1) \text{ and } 0,$$
$$8 \cdot D_2\left(L_2 + \frac{\pi}{4}D_2\right) \le F_2 \le 0,9 \cdot \frac{\pi}{2}D_2(L_2 + D_2);$$

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le 0,8 \cdot \frac{\pi}{2}D_1(L_1 + D_1) \text{ and } 0,$$
$$8 \cdot D_2\left(L_2 + \frac{\pi}{4}D_2\right) \le F_2 \le 0,8 \cdot \frac{\pi}{2}D_2(L_2 + D_2);$$

the first and second actuator have operative surfaces $F_1$ and $F_2$ facing receptacle $R_1$ and, respectively $R_2$ with $$0,7 \cdot \frac{\pi}{2}D_1(L_1 + D_1) \le F_1 \le 1,3 \cdot \frac{\pi}{2}D_1(L_1 + D_1) \text{ and } 0,$$
$$7 \cdot \frac{\pi}{2}D_2(L_2 + D_2) \le F_2 \le 1,3 \cdot \frac{\pi}{2}D_2(L_2 + D_2);$$

the first and second actuator have operative surfaces $F_1$ and $F_2$ facing receptacle $R_1$ and, respectively $R_2$ with $$0,8 \cdot \frac{\pi}{2}D_1(L_1 + D_1) \le F_1 \le 1,2 \cdot \frac{\pi}{2}D_1(L_1 + D_1) \text{ and } 0,$$
$$8 \cdot \frac{\pi}{2}D_2(L_2 + D_2) \le F_2 \le 1,2 \cdot \frac{\pi}{2}D_2(L_2 + D_2);$$

the first and second actuator have operative surfaces $F_1$ and $F_2$ facing receptacle $R_1$ and, respectively $R_2$ with $$0,9 \cdot \frac{\pi}{2}D_1(L_1 + D_1) \le F_1 \le 1,1 \cdot \frac{\pi}{2}D_1(L_1 + D_1) \text{ and } 0,$$
$$9 \cdot \frac{\pi}{2}D_2(L_2 + D_2) \le F_2 \le 1,1 \cdot \frac{\pi}{2}D_2(L_2 + D_2);$$

the first and second actuator have operative surfaces $F_1$ and $F_2$ facing receptacle $R_1$ and, respectively $R_2$ with $$0,7 \cdot \frac{\pi}{2}D_1(L_1 + D_1) \le F_1 \le \frac{\pi}{2}D_1(L_1 + D_1) \text{ and } 0,$$
$$7 \cdot \frac{\pi}{2}D_2(L_2 + D_2) \le F_2 \le \frac{\pi}{2}D_2(L_2 + D_2);$$

the first and second actuator have operative surfaces $F_1$ and $F_2$ facing receptacle $R_1$ and, respectively $R_2$ with $$0,8 \cdot D_1\left(L_1 + \frac{\pi}{4}D_1\right) \le F_1 \le 1,5 \cdot D_1\left(L_1 + \frac{\pi}{4}D_1\right) \text{ and } 0,$$
$$8 \cdot D_2\left(L_2 + \frac{\pi}{4}D_2\right) \le F_2 \le 1,5 \cdot D_2\left(L_2 + \frac{\pi}{4}D_2\right);$$

the first and second actuator have operative surfaces $F_1$ and $F_2$ facing receptacle $R_1$ and, respectively $R_2$ with $$0,8\cdot D_1\left(L_1+\frac{\pi}{4}D_1\right)\le F_1\le 1,4\cdot D_1\left(L_1+\frac{\pi}{4}D_1\right)\text{ and }0,8\cdot D_2\left(L_2+\frac{\pi}{4}D_2\right)\le F_2\le 1,4\cdot D_2\left(L_2+\frac{\pi}{4}D_2\right);$$

the first and second actuator have operative surfaces $F_1$ and $F_2$ facing receptacle $R_1$ and, respectively $R_2$ with $$0,8\cdot D_1\left(L_1+\frac{\pi}{4}D_1\right)\le F_1\le 1,3\cdot D_1\left(L_1+\frac{\pi}{4}D_1\right)\text{ and }0,8\cdot D_2\left(L_2+\frac{\pi}{4}D_2\right)\le F_2\le 1,3\cdot D_2\left(L_2+\frac{\pi}{4}D_2\right);$$

the first and second actuator have operative surfaces $F_1$ and $F_2$ facing receptacle $R_1$ and, respectively $R_2$ with $$0,8\cdot D_1\left(L_1+\frac{\pi}{4}D_1\right)\le F_1\le 1,2\cdot D_1\left(L_1+\frac{\pi}{4}D_1\right)\text{ and }0,8\cdot D_2\left(L_2+\frac{\pi}{4}D_2\right)\le F_2\le 1,2\cdot D_2\left(L_2+\frac{\pi}{4}D_2\right);$$

the first and second actuator have operative surfaces $F_1$ and $F_2$ facing receptacle $R_1$ and, respectively $R_2$ with $$0,8\cdot D_1\left(L_1+\frac{\pi}{4}D_1\right)\le F_1\le 1,1\cdot D_1\left(L_1+\frac{\pi}{4}D_1\right)\text{ and }0,8\cdot D_2\left(L_2+\frac{\pi}{4}D_2\right)\le F_2\le 1,1\cdot D_2\left(L_2+\frac{\pi}{4}D_2\right);$$

the first and second actuator have operative surfaces $F_1$ and $F_2$ facing receptacle $R_1$ and, respectively $R_2$ with $$0,8\cdot D_1\left(L_1+\frac{\pi}{4}D_1\right)\le F_1\le D_1\left(L_1+\frac{\pi}{4}D_1\right)\text{ and }0,8\cdot D_2\left(L_2+\frac{\pi}{4}D_2\right)\le F_2\le D_2\left(L_2+\frac{\pi}{4}D_2\right);$$

the first and second actuator have operative surfaces $F_1$ and $F_2$ facing receptacle $R_1$ and, respectively $R_2$ with $$0,8\cdot D_1\left(L_1+\frac{\pi}{4}D_1\right)\le F_1\le 0,9\cdot D_1\left(L_1+\frac{\pi}{4}D_1\right)\text{ and }0,8\cdot D_2\left(L_2+\frac{\pi}{4}D_2\right)\le F_2\le 0,9\cdot D_2\left(L_2+\frac{\pi}{4}D_2\right);$$

the first and second actuator are each configured as a roller;

the first and second actuator each comprise a roller;

the first and second actuator are each configured as a piston;

the first and second actuator each comprise a piston;

the first and second actuator are each configured as a plunger;

the first and second actuator each comprise a plunger;

the first and second actuator are each equipped with a gel pad;

the first and second actuator each comprise a diaphragm;

the first and second actuator each comprise a plate diaphragm;

the first and second actuator each comprise a spherical diaphragm;

the first and second actuator each comprise a diaphragm made from an elastic monolayer or multilayer sheet material;

the first and second actuator each comprise a diaphragm and one or two rods;

the first and second actuator each comprise a diaphragm and one or two rods mechanically coupled to the diaphragm;

the first and second actuator each comprise a diaphragm and one or two rods mechanically coupled to the diaphragm and the power transmission;

the first and second actuator each comprise a diaphragm equipped with a flange;

the first and second actuator each comprise a diaphragm equipped with a flange and the first and second receptacle $R_1$ and $R_2$ are each equipped with a groove shaped form-fit to the diaphragm flanges of the first and second actuator;

the first and second actuator each comprise a diaphragm equipped with a flange and the first and second receptacle $R_1$ and $R_2$ are each equipped with a groove shaped for leakproof seating of the diaphragm flanges of the first and second actuator;

the dispenser comprises a valve for closing and opening of the outlet of the static mixer;

the valve is arranged between the mixing section and the outlet of the static mixer;

the valve is configured to occupy a closing position when a pressure in the mixing section of the static mixer is less than a preset first threshold pressure and an opening position when a pressure in the mixing section of the static mixer exceeds a preset second threshold pressure;

the valve comprises a diaphragm;

the valve comprises a plate diaphragm;

the valve comprises a spherical diaphragm;

the valve comprises a diaphragm made from an elastic monolayer or multilayer sheet material;

the valve comprises a first and second flow passage with a first and, respectively second connector segment and a diaphragm affixed to the frame or the lid, the first and second flow passage is arranged in the frame and, respectively in the lid such that in form-fit attachment of the lid to the frame the diaphragm is interposed between the first and second flow passage and the first and second connector segment are arranged in facing position at opposite surfaces of the diaphragm;

the dispenser comprises at least one retainer chamber connected in fluid communication with the static mixer between the mixing section and the outlet of the static mixer;

the dispenser comprises at least one retainer chamber connected in fluid communication with the static mixer between the mixing section and the outlet of the static mixer and proximal to the outlet of the static mixer;

the dispenser comprises at least one retainer chamber connected in fluid communication with the static mixer between the mixing section of the static mixer and the valve for closing and opening of the static mixer outlet;

the dispenser comprises at least one retainer chamber connected in fluid communication with the static mixer between the mixing section of the static mixer and the valve for closing and opening of the static mixer outlet and proximal to the valve;

the at least one retainer chamber is arranged in the frame;

the at least one retainer chamber is arranged in the lid;

the at least one retainer chamber comprises a first part arranged in the frame and a second part arranged in the lid;

the dispenser comprises two retainer chambers;

the drive is a manually operable lever ratchet;

the drive is an electric motor;

the dispenser comprises a hydraulic transmission;

the hydraulic transmission comprises a first cylinder with a first piston, a second cylinder with a second piston and a first and second spindle (ball screw) coupled to the first and, respectively second piston;

the hydraulic transmission comprises a first cylinder with a first piston, a second cylinder with a second piston and a spindle (ball screw) coupled to the first and second actuator through a yoke;

the hydraulic transmission comprises a hydraulic fluid;

the hydraulic transmission comprises a hydraulic oil;

the dispenser comprises a mechanical transmission;

the mechanical transmission is configured as planetary gear and comprises a sun gear and a stationary carrier with two or four planet gears;

the sun gear and each of the planet gears have $N_S$ and, respectively $N_P$ teeth with $N_P \geq N_S$;

the mechanical transmission is configured as planetary gear with a stationary carrier with a first and second planet gear and a first and second spindle (ball screw);

the first and second planet gear are coupled to the first and, respectively second actuator through the first and, respectively second spindle (ball screw);

the mechanical transmission is configured as planetary gear with a stationary carrier with a first, second, third and fourth planet gear and a first, second, third and fourth spindle (ball screw);

the first and second planet gear are coupled to the first actuator through the first and, respectively second spindle (ball screw);

the third and fourth planet gear are coupled to the second actuator through the third and, respectively fourth spindle (ball screw);

the dispenser comprises a receptacle for a storage unit for electric power;

the dispenser comprises a receptacle for a battery;

the dispenser comprises a receptacle for a rechargeable battery;

the dispenser comprises electrical wiring for connecting the drive to a storage unit for electric power; and/or the dispenser comprises electrical wiring for connecting the drive to an external source of electric power.

Figure 12:
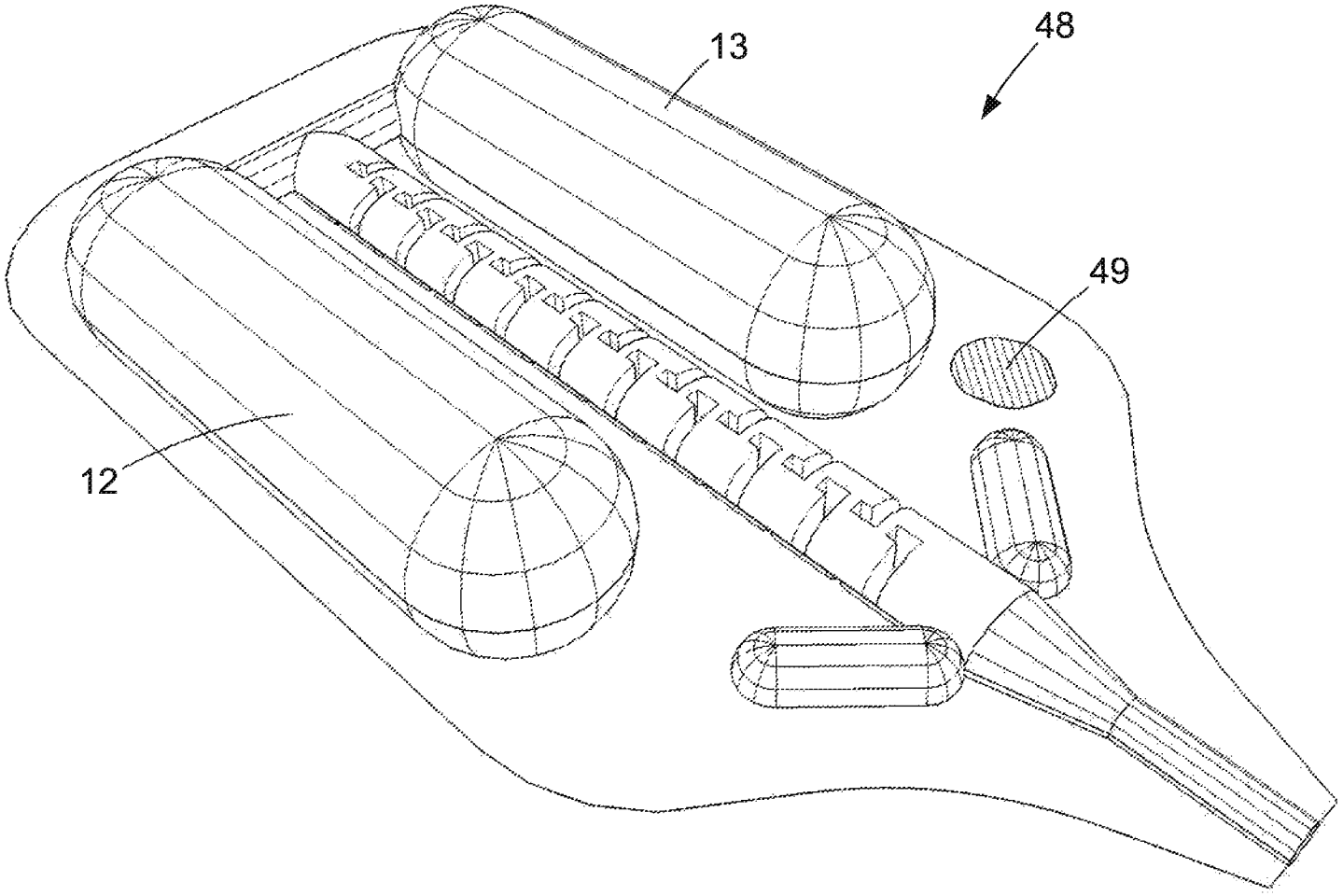
FIG. 12 a schematic illustration of an exemplary disposable container for viscous materials.

The inventive dispenser is designed for discharge of a first and second viscous material from a first and second compartment of a disposable container (cf. FIG. 12). The disposable containers comprise a sleeve consisting of two or more films made from polymeric material. In regular use a disposable container is placed in the dispenser frame and the dispenser lid is shut and locked to the dispenser frame. Thereafter, the dispenser drive is electrically or manually actuated and the thereto coupled first and second actuator extrude the first and second viscous material from the first and, respectively second receptacle $R_1$ and $R_2$, respectively from the therein held container compartments through the static mixer. During the load, dispense and unload step the sleeve of the disposable container must remain intact at all times in order to prevent contact between the viscous materials and the dispenser.

In order to minimize stresses exerted on the container sleeve the first and second receptacle $R_1$ and $R_2$ are configured as elongate cavities having a first and second principal axis along which $R_1$ and $R_2$ have a maximal spatial extent and the first and second actuator are configured for translation or expansion in a direction perpendicular to the principal axes of $R_1$ and $R_2$. Thereby the translation or expansion and retraction travel range of the first and second actuator that is required to extrude a major portion of the first and second viscous material from $R_1$ and $R_2$ and the concomitant deformation and stresses exerted on the container sleeve are minimized.

Figure 11:
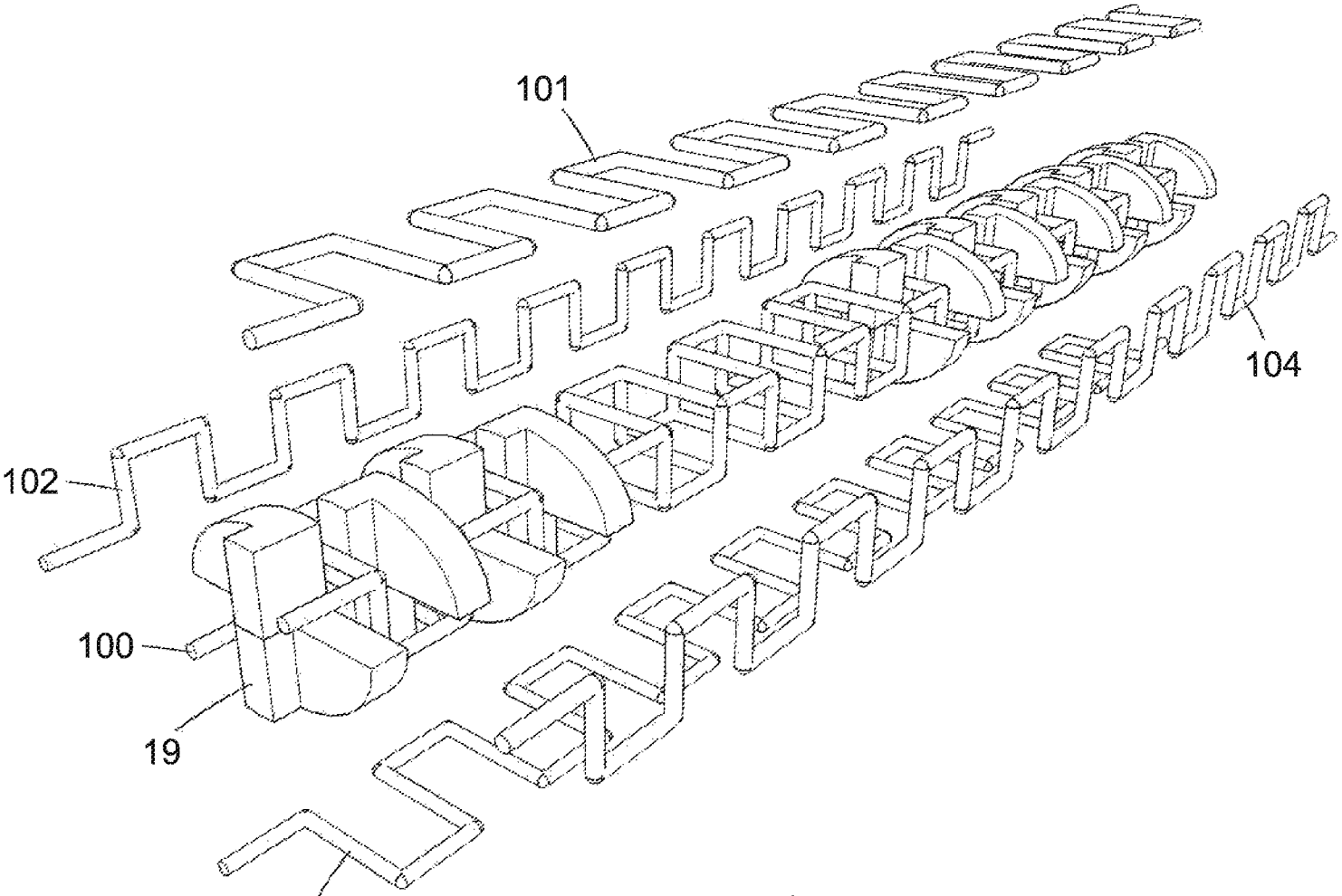
FIG. 11 a schematic illustration of an exemplary static mixer flow duct or flow passage.

For the same reason i.e. to minimize stress exerted on the container sleeve the static mixer is preferably shaped in such manner that its cross-section has an aspect ratio or width to height ratio from 1.1 to 4.0. In an expedient embodiment the static mixer comprises a mixing section having an inner surface with a shape corresponding to a union of a lateral-surface of a cylindrical body with elliptical cross-section and the surfaces of n deflectors with $8 \leq n \leq 120$ arranged along a principal axis of the cylindrical body and a major axis of the elliptical cross-section is larger by a factor of 1.1 to 4.0 than the minor axis of the elliptical cross-section. As a further measure to minimize the mechanical stress exerted on the container sleeve the protrusion of the n deflectors into the mixing section, respectively the cylindrical space with elliptical cross-section bound by the half-lateral-surfaces of the first and second channel is limited to ≤80% along and relative to a first and second inner diameter of the cylindrical space. Furthermore, according to a preferred embodiment of the inventive dispenser the edges of the n deflectors are beveled or rounded. Notwithstanding, the n deflectors are configured in such manner that the flow passage bound by the mixing section corresponds to a union of four meander-shaped and partially overlayed ducts as depicted in FIG. 11. In the framework of the present invention the term "cylindrical body" designates a body having constant cross-section and finite extension in a direction perpendicular to said cross-section. The cross-section of the "cylindrical body" may have elliptical, circular, polygonal or rectangular shape. The axis perpendicular to the constant cross-section of the "cylindrical body" is termed "principal axis".

The term "first diameter" and "second "diameter" designate a first and second maximal diameter of a cylindrical body with constant cross-section along a first and second direction respectively, with the first and second direction being perpendicular to each other and collinear to the cross-section.

The term "equivalent diameter" of a cross-section or an area pertains to the diameter of a circle having the same areal size measured in units of length×length e.g. $cm^2$.

The term "operative surface" of an actuator, such as a piston, a plunger or diaphragm designates the actuator surface which contacts the sleeve of a disposable container situated in the first and second dispenser receptacle and exerts pressure thereon to extrude viscous materials contained in the disposable container.

FIG. 1 schematically shows a dispenser 1 according to the present invention, comprising a drive 2, a power transmission 3, a first and second actuator 4 and 5, a first and second receptacle 6 ($R_1$) and 7 ($R_2$) for a first and second viscous material 12 and 13 and a static mixer 14. Drive 2 is electrically or manually operable. Power transmission 3 is configured to translate motion of drive 2 into motion of the first and second actuator 4 and 5. In expedient embodiments of dispenser 1 drive 2 is a lever ratchet or an electric motor. Power transmission 3 is mechanically coupled to drive 2 and the first and second actuator 4 and 5 and is configured as mechanical or hydraulic power transmission. In an expedient embodiment power transmission 3 is configured as hydraulic power transmission and comprises a first cylinder with a first piston, a second cylinder with a second piston and a first and second spindle (ball screw) coupled to the first and, respectively second actuator 4, 5. In another expedient embodiment power transmission 3 is configured as planetary gear and comprises a sun gear and a stationary carrier with two or four planet gears. First and second receptacle 6 and 7 are configured as cavities or chambers suitable for accommodating a given volume of a first and, respectively second viscous material 12 and 13. First and second receptacle 6 and 7 each comprise an outlet 8 and 9. First and second actuator 4 and 5 are movable into and out of the first and second receptacle 6 and 7. When the first and second actuator 4 and 5 are moved into the first and second receptacle 6, 7 therein contained first and second viscous material 12 and 13 are extruded through the first and second outlet 8 and 9 into ducts 17 and 18. Duct 17 and 18 connect outlet 8 and 9 to an inlet 15 of static mixer 14. Static mixer 14 is configured as duct or flow passage and comprises an outlet 16 and a multitude of deflectors 19 arranged between inlet 15 and outlet 16. Deflectors 19 promote mixing of the first and second viscous material 12 and 13 during passage from inlet 15 to outlet 16 of static mixer 14. In an expedient embodiment dispenser 1 comprises a valve 21 arranged within static mixer 14 proximal to outlet 16. Valve 21 is configured to seal and open outlet 16 in dependence of the pressure of viscous materials 12 and 13 extruded through static mixer 14. Advantageously, valve 21 is configured as prestressed diaphragm and occupies a closed position when the pressure of viscous materials 12, 13 inside static mixer 14 is less than a preset first threshold pressure and an open position when the pressure of viscous materials 12, 13 inside static mixer 14 exceeds a preset second threshold pressure. Preferably, dispenser 1 comprises one or more retainer chambers 25, 26 for retention of insufficiently mixed viscous materials 12, 13. In closed position of valve 21 viscous materials 12, 13 passing through static mixer 14 are redirected into retainer chambers 25, 26. Once retainer chambers 25, 26 are completely filled the pressure of viscous materials 12, 13 inside static mixer 14 rises until the second threshold or opening pressure of valve 21 is exceeded. In an expedient embodiment static mixer 14 comprises a first and second channel which each are equipped with a multitude of deflectors 19.

Figure 2:
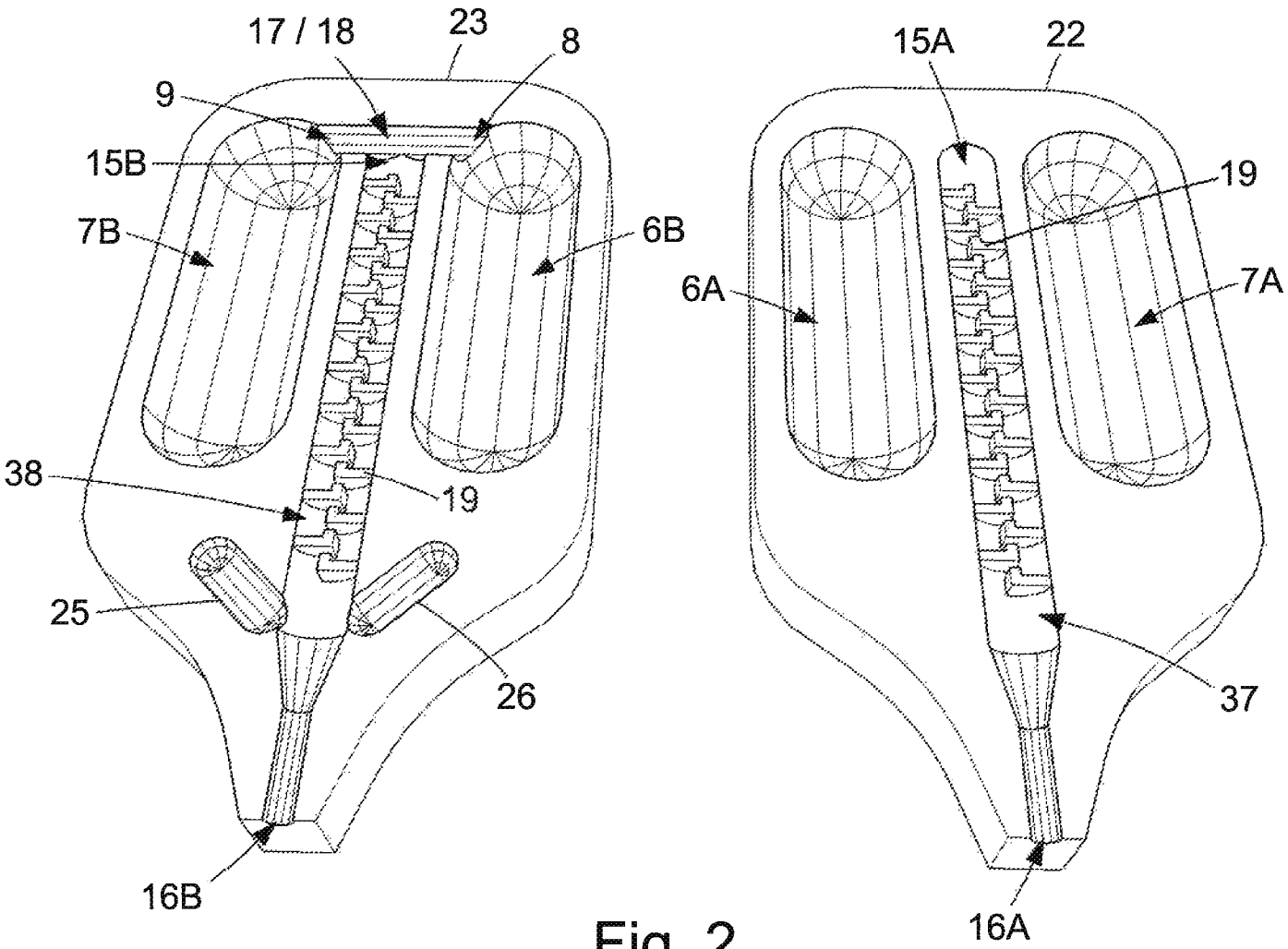
FIG. 2 is a schematic illustration of an exemplary dispenser frame and lid is.

FIG. 2 shows a perspective view of a frame 22 and a lid 23 of the inventive dispenser in side by side arrangement. The first and second receptacle $R_1$, $R_2$ are each configured as two-part cavity of which a first part 6A, 7A is arranged in frame 22 and a second part 6B, 7B is arranged in lid 23. Preferably, the inner surfaces of the first and second receptacle $R_1$, $R_2$ have a cylindrical shape with semi-spherical front-ends. Second receptacle parts 6B and 7B in lid 23 comprise a first and, respectively second outlet 8, 9. Frame 22 comprises a first channel 37 of the static mixer and lid 23 comprises a second channel 38 of the static mixer. The first and second static mixer channel 37, 38 each comprise a multitude of deflectors 19, an inlet 15A, respectively 15B and an outlet 16A, respectively 16B. Lid 23 comprises two ducts 17, 18 which connect outlets 8, 9 to inlets 15A and 15B of the first and second channel 37, 38 of the static mixer. Lid 23 further comprises two retainer chambers 25, 26 for retention of insufficiently mixed viscous materials.

FIG. 2 illustrates an expedient embodiment of the inventive dispenser comprising a first and second actuator each configured as diaphragm for discharge of the first and, respectively second receptacle. The first and second diaphragm actuator constitute a deformable boundary of the first and, respectively second receptacle and are preferably arranged in frame 22. Accordingly, in FIG. 2 reference signs 6A and 7A also pertain to the operative surfaces of a first and second diaphragm actuator in a retracted state.

Figure 3:
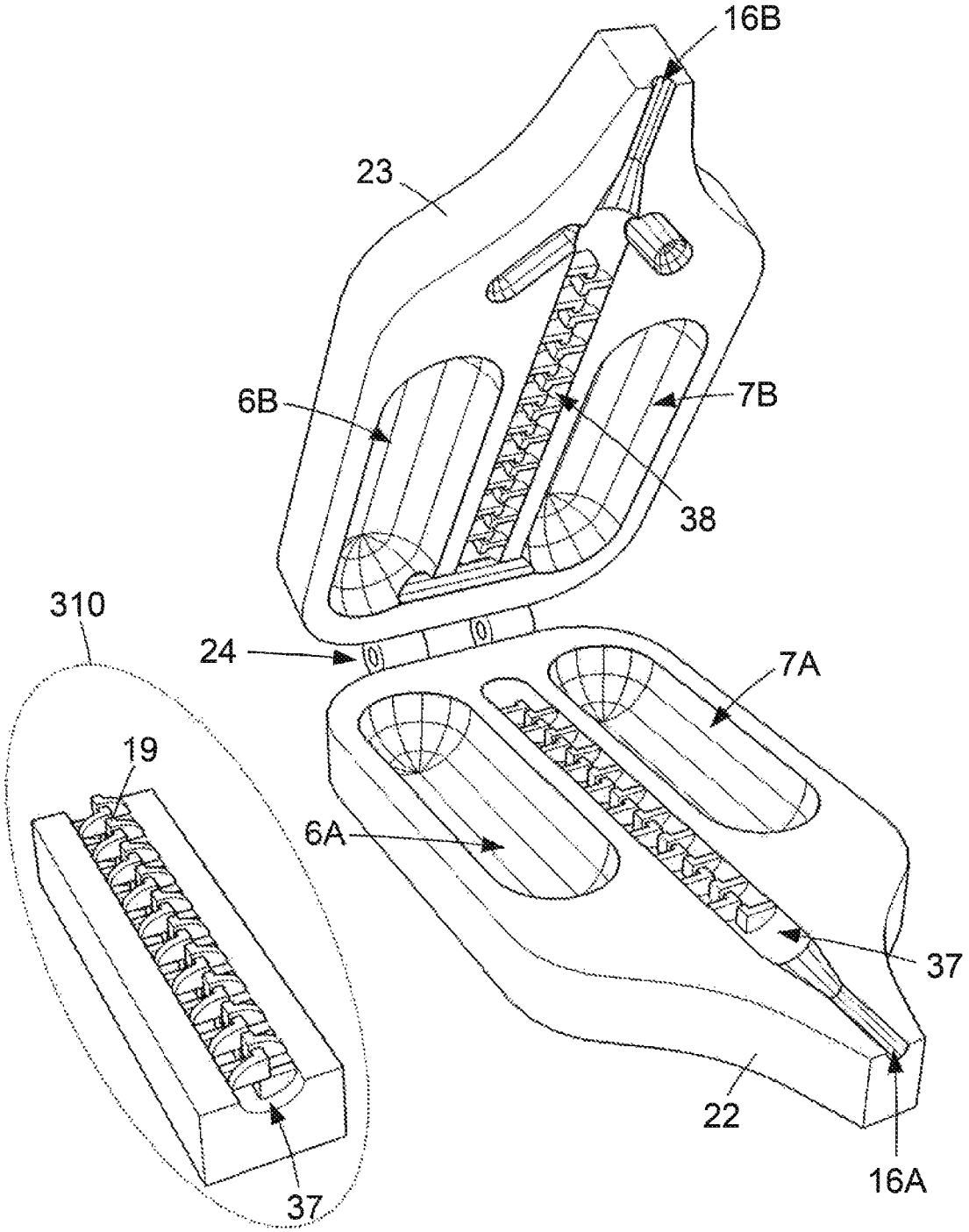
FIG. 3 is a schematic illustration of a perspective view of an exemplary dispense with a frame and lid in open position.

FIG. 3 shows a perspective view of frame 22 and lid 23 in an open position of the inventive dispenser. The reference signs of FIG. 3 refer to the same features and have the same meaning as stated above in conjunction with FIG. 2. FIG. 3 further shows a hinge 24 through which lid 23 is pivotably coupled to frame 22. In a closed position of the dispenser the second static mixer channel 38 in lid 23 is arranged in facing position relative to the first static mixer channel 37 in frame 22. The thereby resulting spatial arrangement of deflectors 19 in the mixing sections of the first and second static mixer channel 37 and 38 is shown in FIG. 3 as inset 310. In the closed position depicted in inset 310 the mixing sections of the first and second static mixer channel 37, 38 and therein arranged deflectors 19 bound a flow passage comprised of four meander-shaped interconnected and partly overlayed ducts (cf. FIG. 9). As above mentioned in the context of FIG. 2 reference signs 6A and 7A also pertain to the operative surfaces of a first and second diaphragm actuator in retracted state.

In an expedient embodiment the first and second mixer channel 37, 38 form integral parts of frame 22 and, respectively lid 23.

In another expedient embodiment the static mixer comprises a first and second die that are reversibly insertable into sockets arranged in frame 22 and, respectively lid 23. This configuration affords facile replacement and use of static mixers having mixing sections with shapes that are adapted and optimized for mixing of viscous fluids of different types. Preferably, the first and second die of the static mixer are held in the respective socket in frame 22 and lid 23 through suitable fixtures, such as snug-fit tongues and grooves or snug-fit pins and blind holes.

Figure 4:
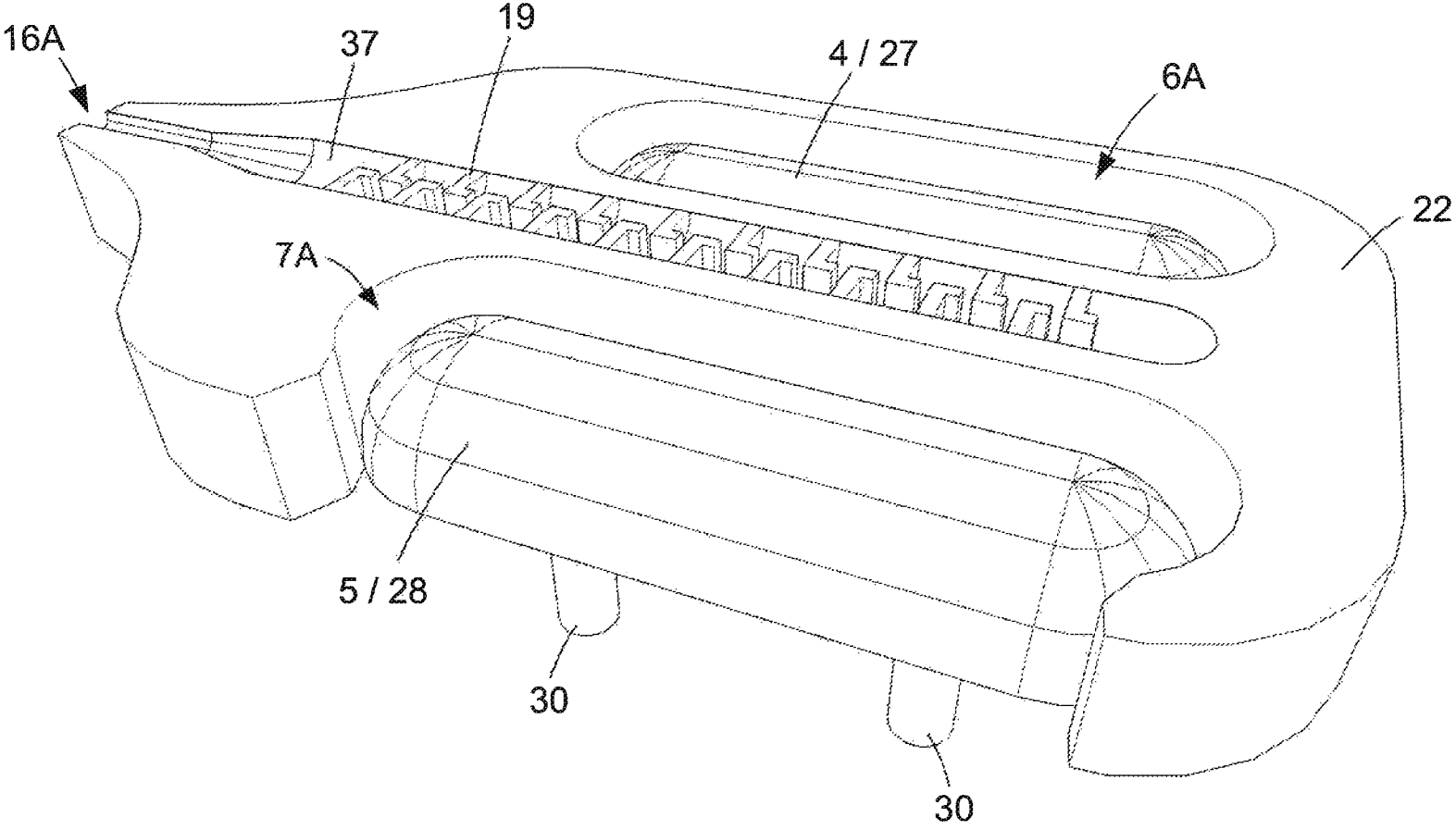
FIG. 4 is a schematic illustration of a partial cutaway view of an exemplary frame with actuators.

FIG. 4 shows a perspective partially cutaway view of frame 22 with first parts 6A, 7A of a first and second receptacle $R_1$, $R_2$ and therein protruding first and, respectively second actuator 4, 5. The first and second actuator 4, 5 are mounted on rods 30 that are coupled to a mechanical power transmission (not shown in FIG. 4). The first and second actuator 4, 5 have operative surfaces 27 and 28 which upon advancement into the first and second receptacle $R_1$, $R_2$ extrude therein contained first and second viscous materials. In an expedient embodiment operative surfaces 27 and 28 each have a shape corresponding to a union of a half-lateral-surface of a cylindrical body with elliptical or circular cross-section and the surfaces of a first and second half-dome arranged at the cylindrical body front ends. Aside from the depiction in FIG. 5 operative surfaces 27 and 28 may each have a shape corresponding to a union of a half-lateral-surface of a cylindrical body with polygonal, rectangular or circular cross-section and the surfaces of a first and second half-dome arranged at the cylindrical body front ends.

Figure 5:
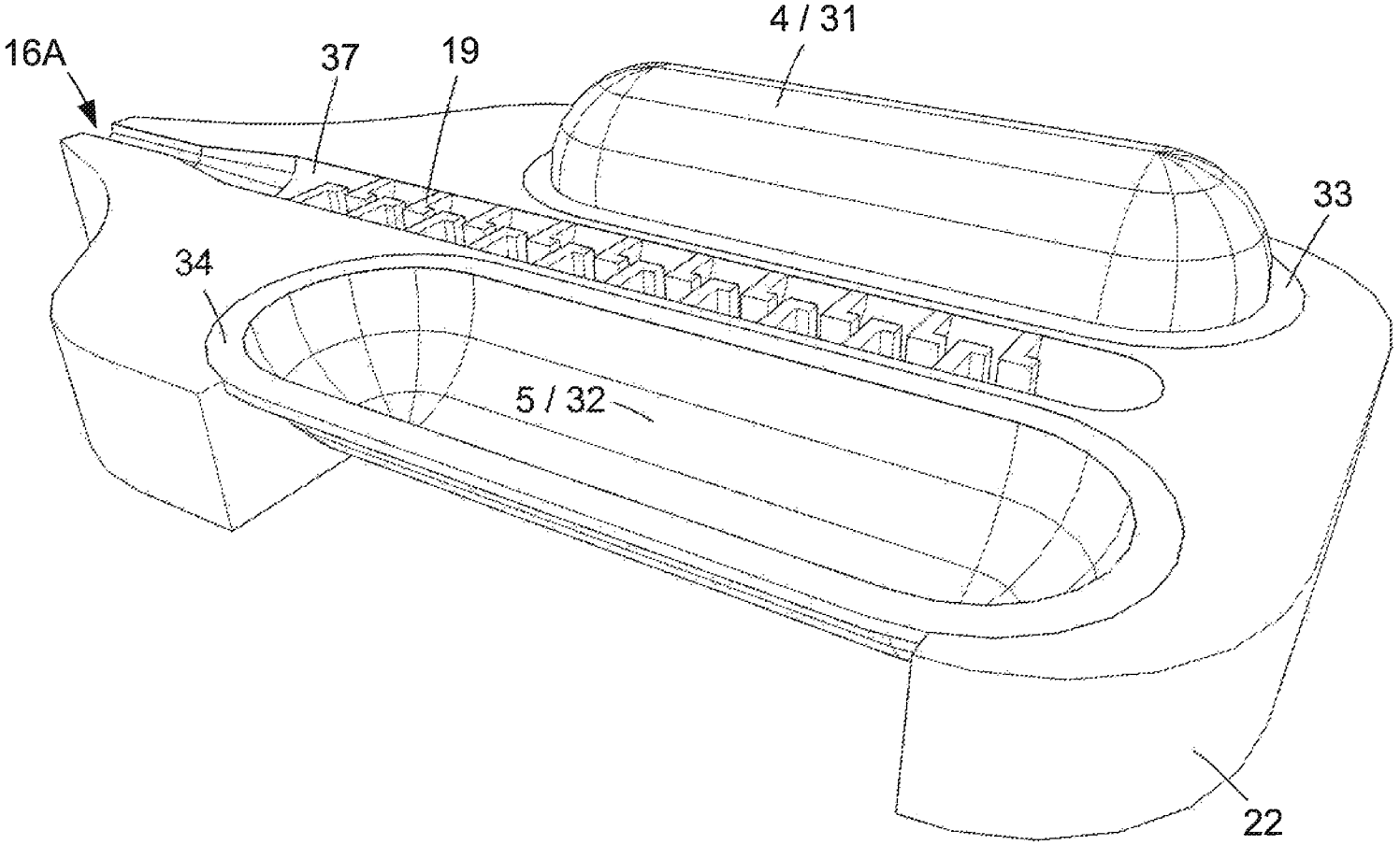
FIG. 5 is a schematic illustration of a partial cutaway view of an exemplary frame with diaphragm actuators.

FIG. 5 shows a perspective partially cutaway view of frame 22 with first parts 6A, 7A of the first and second receptacle $R_1$, $R_2$ and first and second actuator 4, 5 configured as first and, respectively second diaphragm 31, 32. For illustrative purposes the first diaphragm 31 is shown in a fully protruded position whereas the second diaphragm 32 is depicted in a retracted position. Under normal operating conditions of the inventive dispenser the first and second diaphragm are displaced synchronously contrary to the illustrative depiction in FIG. 5. In an expedient embodiment the first and second diaphragm 31, 32 each comprise a flange 33, 34 seated in suitably shaped grooves arranged in frame 22.

In an expedient embodiment the first and second diaphragm 31, 32 are each mechanically actuated via one or two rods (not shown in FIG. 4). To this end the first and second diaphragm 31, 32 are each attached to said rods via suitable fixtures such as keyhole-shaped tongue and groove fixtures.

In another expedient embodiment the first and second diaphragm 31, 32 are each hydraulically actuated through a hydraulic power transmission (not shown in FIG. 4) containing a hydraulic fluid. The hydraulic transmission comprises two or more ducts with outlets arranged in frame 22 opposite to the operative surface of each the first and second diaphragm 31, 32, i.e. in the depiction of FIG. 5 underneath the first and second diaphragm 31, 32. In such hydraulic embodiment flanges 33 and 34 of the first and second diaphragm and thereto corresponding grooves in frame 22 are configured as leakproof gasket. To this end the grooves in frame 22 each comprise either a circumferential undercut or circumferential recess and each of flanges 33 and 34 comprises either a lateral extension or a bulge shaped form-fit to said undercut or recess. In an alternative expedient embodiment diaphragm flanges 33 and 34 are each bonded to frame 22 through adhesive.

Regarding hydraulic actuation of the first and second diaphragm 31, 32 it is noted that in a closed position of the inventive dispenser, wherein the dispenser lid is force-fit attached and locked to frame 22, diaphragm flanges 33, 34 are fixated in the corresponding grooves in frame 22 in a high-pressure leakproof manner. The afore described measures for fixation of diaphragm flanges 33, 34 to frame 22 are intended to prevent leakage of hydraulic fluid under ambient pressure and are not required to provide high-pressure leakproof sealing.

Figure 6:
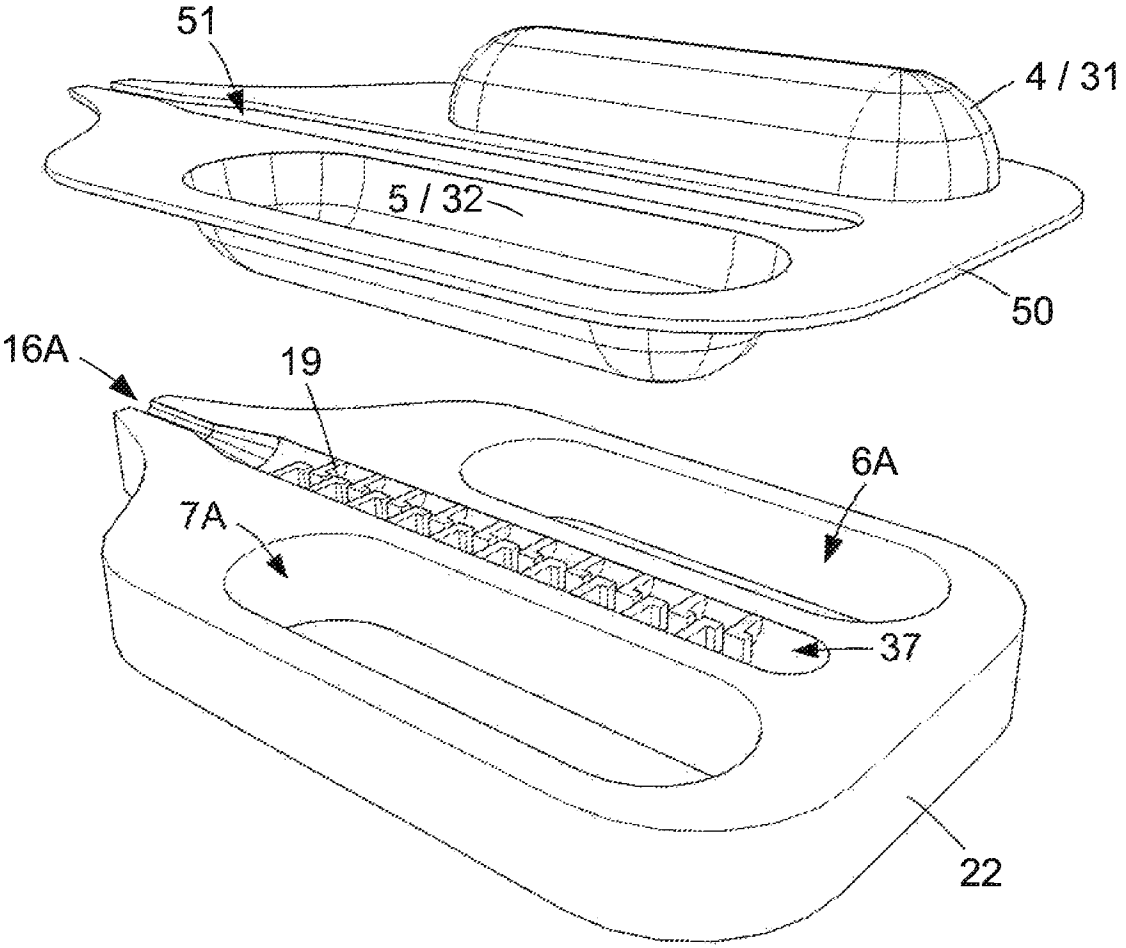
FIG. 6 is a schematic illustration of a perspective view of an exemplary gasket and actuator diaphrams.

FIG. 6 shows a perspective view of a frame 22 and a gasket 50 of an expedient embodiment of the inventive dispenser. Frame 22 comprises a first channel 37 of a static mixer with a multitude of deflectors 19 and first parts 6A, 7A of a first and, respectively second receptacle.

A cut-out 51 of gasket 50 is shaped according to the static mixer contour. Gasket 50 comprises first and second actuators 4, 5. Each the first and second actuator 4, 5 is configured as diaphragm 31, 32 and forms an integral part of gasket 50. For illustrative purposes first actuator 4 is depicted in an expanded state and second actuator 5 in a retracted state. Contrary to the illustrative depiction in FIG. 6 under normal operating conditions the first and second actuator 4, 5 are simultaneously expanded or retracted.

In an expedient embodiment gasket 50 is made from a sheet consisting of an elastic material, selected from the group comprising natural rubber, synthetic rubber, polymers and mixtures thereof. Preferably, gasket 50 is made from a composite sheet material comprising a fabric or filaments made from a polymeric or metallic material.

Gasket 50 is either affixed to frame 22 or a dispenser lid (not shown in FIG. 6).

In an alternative expedient embodiment of the inventive dispenser (not shown in FIG. 6) the first and second actuator do not form an integral part of the gasket. For example the first and second actuator may be configured as pistons, plungers or discrete diaphragms. In such embodiments the gasket comprises two cut-outs shaped in accordance with the contour of the first and second receptacle or with the contour of first receptacle parts 6A, 7A.

In yet another expedient embodiment of the inventive dispenser (not shown in FIG. 6) the gasket extends across the outlet section of the static mixer and forms a diaphragm for an outlet valve similar to the one described subsequently in the context of FIGS. 7*a* and 7*b*.

Figure 7A:
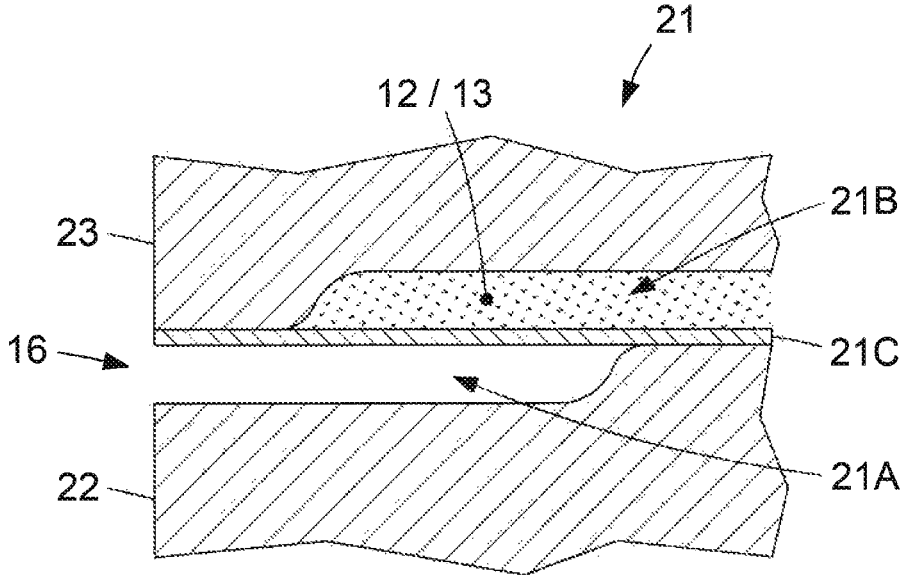
FIG. 7A is a schematic illustration of a cross-section of an exemplary closed outlet valve.
Figure 7B:
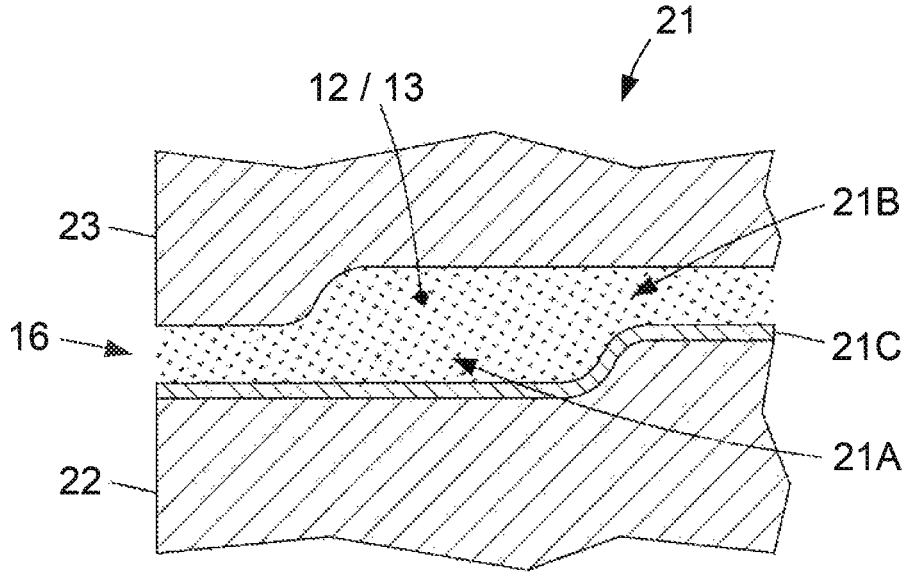
FIG. 7B is a schematic illustration of cross-section of an exemplary open outlet valve.

FIGS. 7*a* and 7*b* show schematic cross-sections of an outlet valve 21 in closed and, respectively open state. Valve 21 comprises a first flow passage 21B, a second flow passage 21A and a diaphragm 21C. Each the first and second flow passage 21B, 21A form part of the static mixer. First flow passage 21B is situated in dispenser lid 23 and second flow passage 21A in dispenser frame 22. In an alternative equally expedient embodiment of valve 21 (not shown in FIG. 7) first flow passage 21B is situated in frame 22 and second flow passage 21A in lid 23. First flow passage 21B is connected to the mixing section of the static mixer (not shown in FIG. 7). Viscous materials 12, 13 extruded from a disposable container flow from the mixing section into first flow passage 21B. Second flow passage 21A opens into dispenser outlet 16.

Viscous materials 12, 13 are enclosed in a flexible sleeve of a disposable container (cf. FIG. 12) and do not contact the first and second flow passage 21B, 21A, diaphragm 21C or any other part of the dispenser. For simplicity and clear perception the flexible sleeve of the disposable container is not shown in FIGS. 7*a* and 7*b*.

Diaphragm 21C is made from an elastic sheet material and affixed to either frame 22 or lid 23. In form-fit attachment of lid 23 to frame 22—as depicted in FIGS. 7*a* and 7*b*—diaphragm 21C is interposed and clamped between frame 22 and lid 23 in areas bounding both the first and second flow passage 21B and 21A. Adjacent to either the first or second flow passage 21B, 21A diaphragm 21C merely abuts on frame 22 or lid 23 and may be separated therefrom.

In the closed state of valve 21 depicted in FIG. 7*a* diaphragm 21C is suspended between the first and second flow passage 21B, 21A and blocks flow of viscous materials 12, 13 from the mixing section of the static mixer to dispenser outlet 16. Diaphragm 21C is configured in a manner i.e. has an elastic modulus such that deflection of diaphragm 21C from a planar conformation requires exertion of a force or pressure above a defined threshold.

FIG. 7*b* shows an open state of valve 21 wherein the pressure of viscous materials 12, 13 exceeds the threshold such that diaphragm 21C is deflected and forms an aperture through which viscous materials 12, 13 flow from the first flow passage 21B to the second flow passage 21A. Contrary to the illustrative depiction in FIG. 7*b*, in practice diaphragm 21C may not fully conform to the contour of second flow passage 21A.

In an expedient embodiment of the inventive dispenser the diaphragm of valve 21 forms an integral part of a gasket similar to the one described above in the context of FIG. 6.

Figure 8:
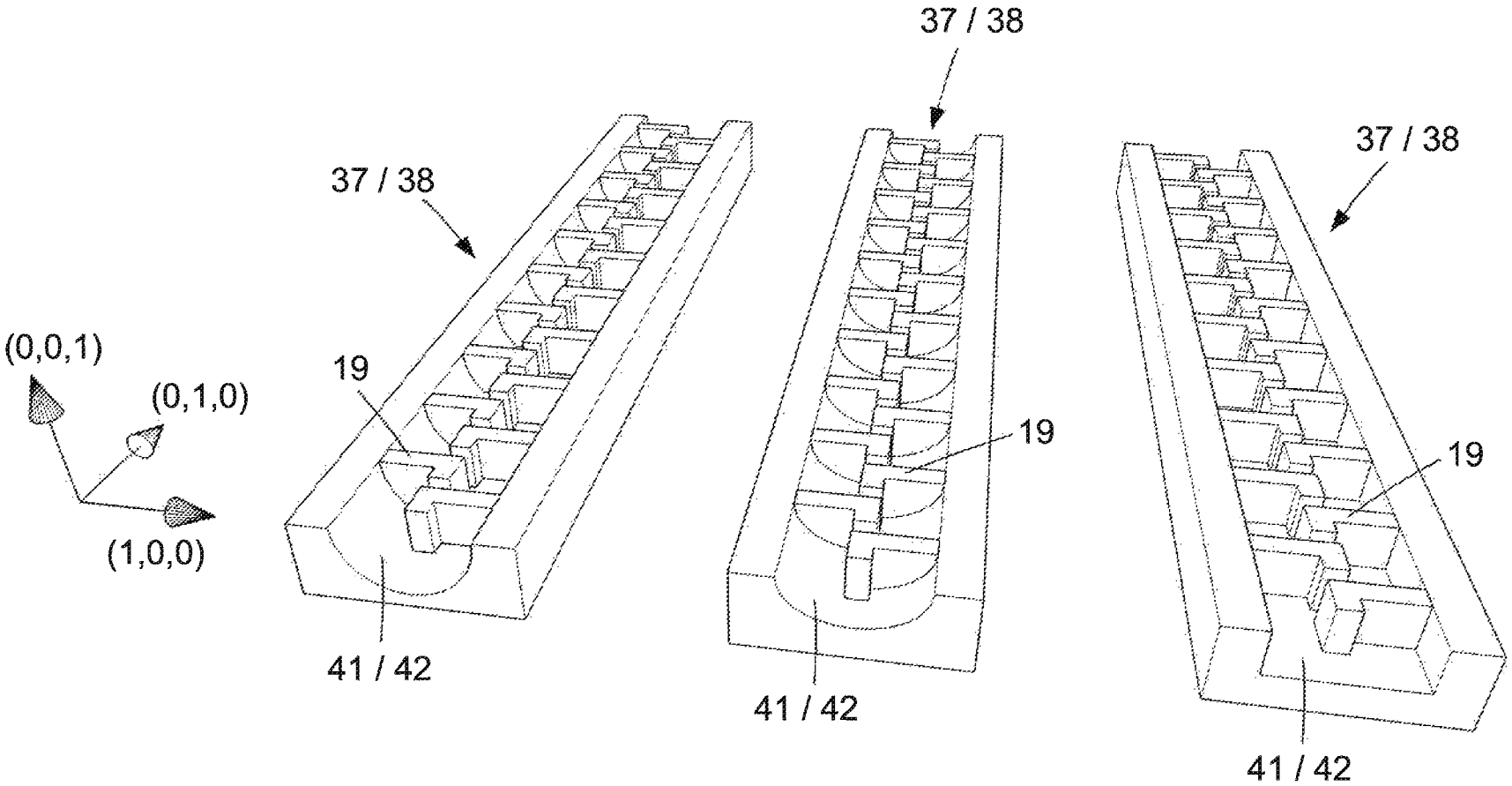
FIG. 8 is a a schematic illustration of exemplary static mixer channel shapes.

FIG. 8 depicts mixing sections of first and second static mixer channels 37, 38 with inner surfaces 41 and, respectively 42 of varying shape corresponding to a union of a half-lateral-surface of a cylindrical body with spherical, elliptical or rectangular cross-section and the surfaces of a multitude of deflectors 19. FIG. 8 further shows a coordinate system with orthogonal axes (1,0,0), (0,1,0), (0,0,1). Principal axes of the mixing sections of the first and second channel 37, 38 are parallel to coordinate axis (0,1,0). Aside from a cylindrical body with spherical, elliptical or rectangular cross-section inner surfaces 41 and 42 may also have a shape corresponding to a union of a half-lateral-surface of a cylindrical body with polygonal cross-section, such as a hexagon or octagon, and the surfaces of a multitude of deflectors 19. Deflectors 19 depicted in FIG. 8 each have an L-shaped cross-section in a sectional plane spanned by coordinate axes (1,0,0) and (0,1,0). Aside from deflectors 19 shown in FIG. 8 having an L-shaped cross-section the present invention encompasses deflectors having various shapes, such as depicted in FIG. 10.

Figure 9:
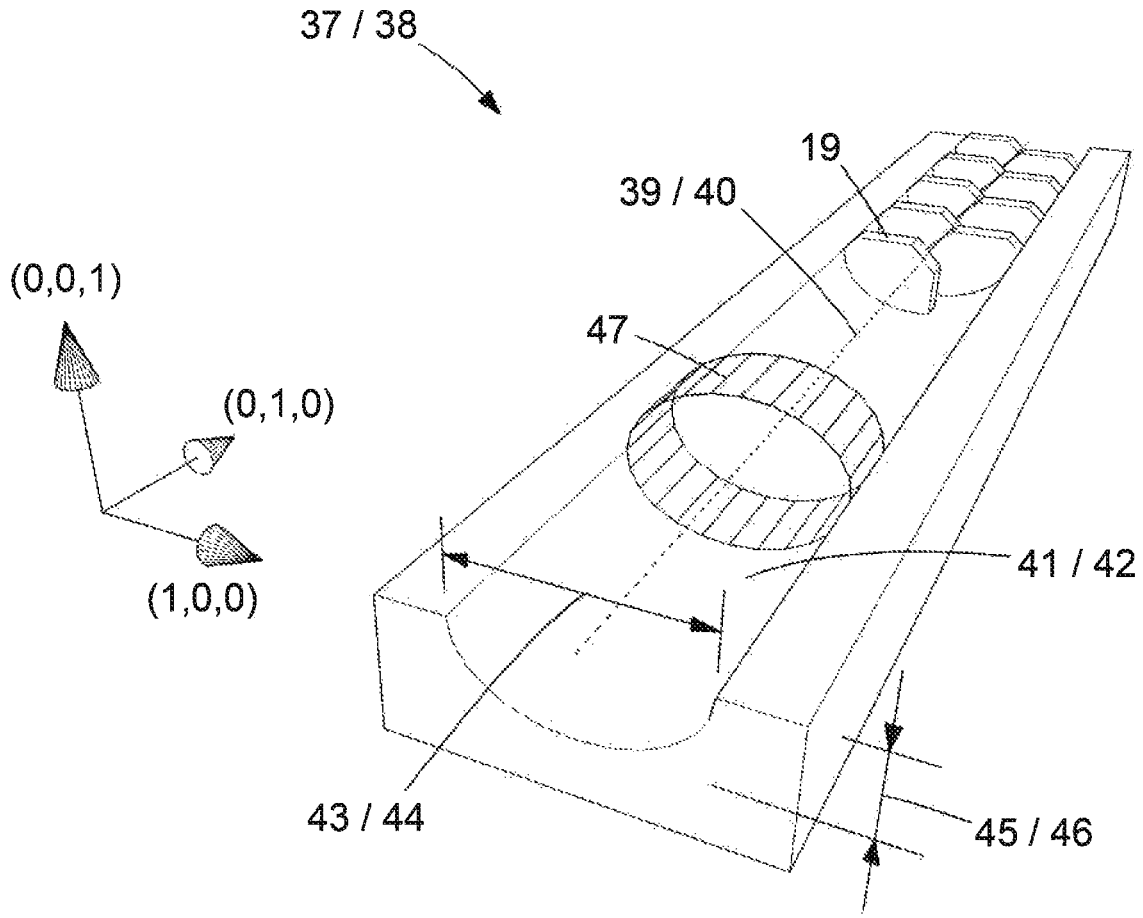
FIG. 9 a schematic illustration of basic shape parameters of exemplary static mixer channels.

FIG. 9 schematically shows geometric features of mixing sections of the first and second channel 37 and 38 of the static mixer with inner surfaces 41 and 42 each corresponding to a union of a half-lateral-surface of a cylindrical body 47 with elliptical cross-section and the surfaces of a multitude of deflectors 19. FIG. 9 further shows a coordinate system with orthogonal axes (1,0,0), (0,1,0), (0,0,1). Cylindrical body 47 has a first maximal diameter along direction (1,0,0) and a second maximal diameter along direction (0,0,1). The first and second diameter of cylindrical body 47 correspond to the length of a major and, respectively minor axis of the elliptical cross-section of cylindrical body 47. Principal axes 39 and 40 are parallel to coordinate axis (0,1,0). In FIG. 9 part of the deflectors are omitted in order to facilitate visual perception. Aside from the depiction in FIG. 9 cylindrical body 47 may have a polygonal, rectangular or circular cross-section. The mixing sections of the first and second channel 37 and 38 have principal axes 39 and 40 which coincide with the principal axis of cylindrical body 47. In expedient embodiments of the inventive dispenser the mixing sections of the first and second channel 37, 38 have congruent shapes such that in juxtaposition—i.e. when the dispenser lid is form-fit attached to the dispenser frame—inner surface 41 may be transformed into inner surface 42 by a 180° rotation around principal axis 39 or 40 and vice versa. Alternatively, inner surface 41 may be transformed into inner surface 42 by consecutive mirroring along two axes that are perpendicular to each other and principal axis 39 or 40 and vice versa. Inner surface 41 has a diameter 43 and a height 45 corresponding to the length of the major axis and, respectively half the length of the minor axis of the elliptical cross-section of cylindrical body 47. Likewise, inner surface 42 has a diameter 44 and a height 46 corresponding to the length of the major axis and, respectively half the length of the minor axis of the elliptical cross-section of cylindrical body 47. In embodiments where cylindrical body 47 has a rectangular cross-section diameter 43, 44 and height 45, 46 correspond to the length of a first side and, respectively half the length of a second side of the rectangle. In embodiments where cylindrical body 47 has a circular cross-section diameter 43, 44 and height 45, 46 correspond to the diameter and, respectively the radius of the circle. In embodiments where cylindrical body 47 has a polygonal cross-section diameter 43, 44 and height 45, 46 correspond to the equivalent diameter and, respectively half the equivalent diameter of a circle having an area that is identical to the area of the polygon. In expedient embodiments deflectors 19 protrude from the half-lateral-surface of cylindrical body 47 in the direction of coordinate axis (1,0,0) by a distance of 40% to 80% of diameter 43 and 44 i.e. by a distance of 40% to 80% of the first diameter of cylindrical body 47. In further expedient embodiments deflectors 19 protrude from the half-lateral-surface of cylindrical body 47 in the direction of coordinate axis (0,0,1) by a distance of 80% to 160% of height 45 and 46 i.e. by a distance of 40% to 80% of the second diameter of cylindrical body 47. In yet further expedient embodiments deflectors 19 protrude from the half-lateral-surface of cylindrical body 47 in the direction of coordinate axis (1,0,0) by a distance of 40% to 80% of diameter 43 and 44 and in the direction of coordinate axis (0,0,1) by a distance of 80% to 160% of height 45 and 46. With increasing protrusion distance of deflectors 19 from the half-lateral-surface of cylindrical body 47 mixing of the first and second viscous material in the static mixer is intensified, however, at the same time the ram pressure is also increased. Through proper dimensioning of deflector protrusion the ratio of mixing intensity and ram pressure can be adjusted and optimized for different materials with viscosities that vary in a broad range.

Figure 10:
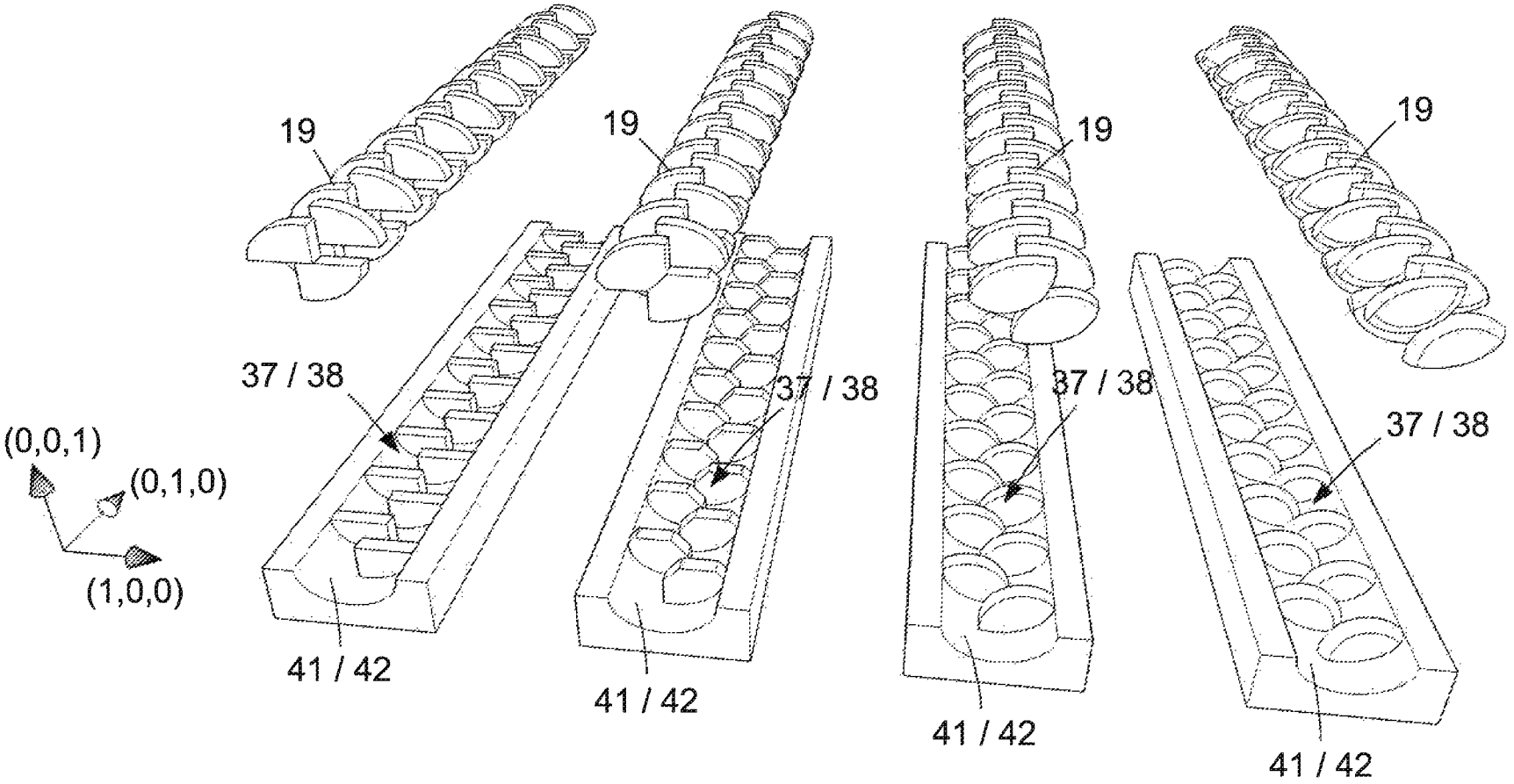
FIG. 10 a schematic illustration of exemplary static mixer deflector shapes.

FIG. 10 shows a perspective view of various embodiments of mixing sections of a first and second channel 37, 38 of the static mixer with inner surfaces 41 and 42 each corresponding to a union of a half-lateral-surface of a cylindrical body with elliptical cross-section and the surfaces of a multitude of deflectors 19. FIG. 10 further shows a coordinate system with orthogonal axes (1,0,0), (0,1,0), (0,0,1). Principal axes of the mixing sections of the first and second channel 37, 38 are parallel to coordinate axis (0,1,0). Aside from a cylindrical body with elliptical cross-section inner surfaces 41 and 42 may also have a shape corresponding to a union of a half-lateral-surface of a cylindrical body with polygonal, rectangular or circular cross-section and the surfaces of deflectors 19. As depicted in FIG. 10 deflectors 19 can have an essentially rhombohedral shape having a rectangular cross-section in a sectional plane spanned by coordinate axes (1,0,0) and (0,1,0). In a sectional plane spanned by coordinate axes (1,0,0) and (0,0,1) deflectors 19 can have a rectangular, polygonal, circular or elliptical cross-section. As afore explained the inventive dispenser is designed for use with disposable containers for viscous materials which have a sleeve consisting of two or more films made from polymeric material (cf. FIG. 12). When the viscous materials are extruded from the disposable container a pressure is applied to the sleeve such that it conforms to the inner surfaces of the dispenser, and in particular to inner surfaces 41 and 42. In expedient embodiments of the inventive dispenser the edges of deflectors 19 are rounded or beveled in order to minimize stresses exerted on the container sleeve.

Figure 13:
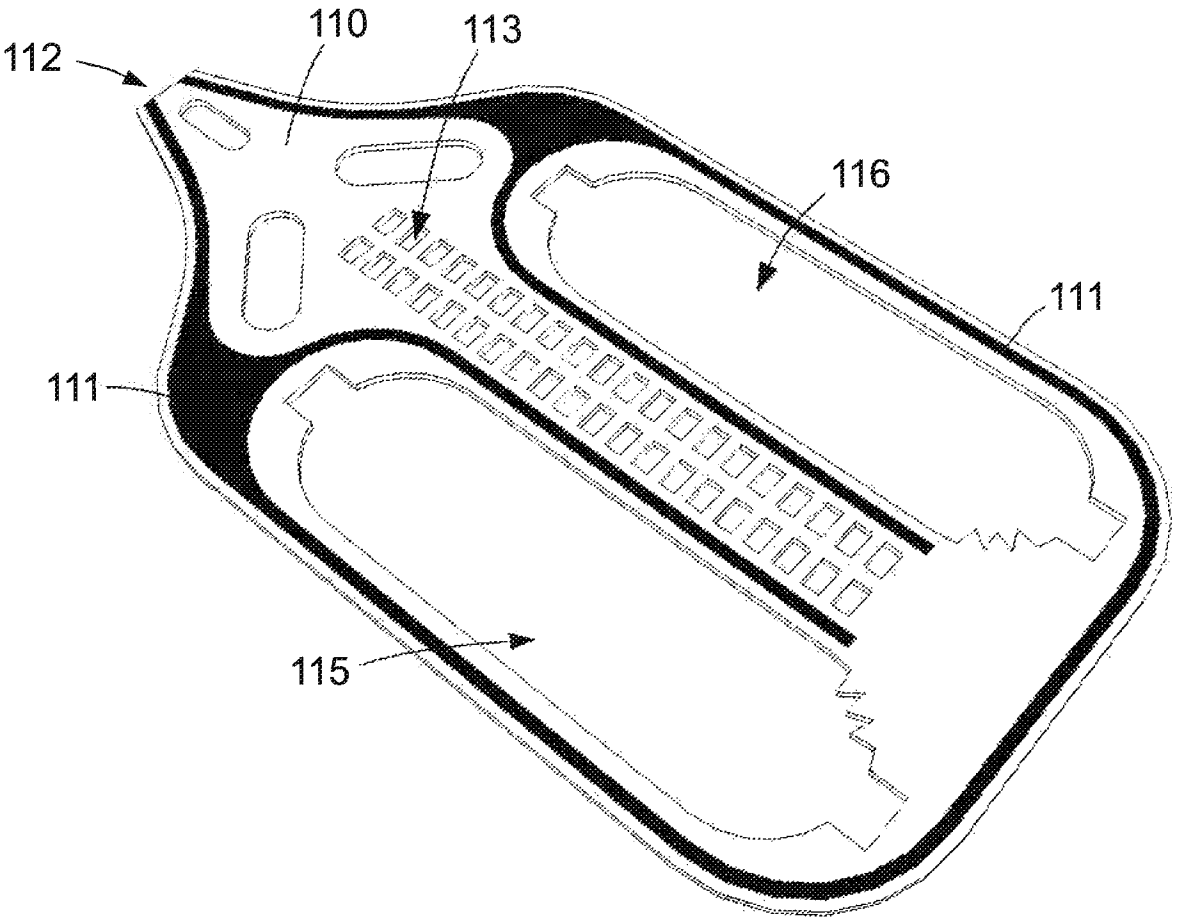
FIG. 13 a schematic illustration of an exemplary carrier sheet of a disposable container comprising a multitude of apertures for a mixing tube.

FIG. 11 shows a perspective cutaway view of a duct or flow passage 100 bound by the mixing section of a static mixer of the present invention and therein arranged deflectors 19. For improved visual perception the outer wall and part of the deflectors of the static mixer are omitted in the depiction of FIG. 11. Duct or flow passage 100 is corresponds to a union of four meander-shaped and partially overlayed ducts 101, 102, 103, 104 which are shown in exploded view. The meander plane of duct 101 is coplanar to the meander plane of duct 103 and orthogonal to the meander planes of duct 102 and 104. Likewise, is the meander plane of duct 102 coplanar to the meander plane of duct 104 and orthogonal to the meander planes of duct 101 and 103. In a particularly expedient embodiment the inventive dispenser is configured for a disposable container that comprises a carrier sheet or shield with a multitude of apertures such as depicted in FIG. 13. The multitude of apertures are contained within a mixing tube of the disposable container. When the disposable container is inserted in the inventive dispenser and the lid attached to the frame in a form-fit manner the carrier sheet or shield with the multitude of apertures is interposed between deflectors 19 of the first and second channel of the static mixer, i.e. in the depiction of FIG. 11 between the upper and lower deflector rows and a sleeve of the disposable container. The multitude of apertures are arranged in the carrier sheet or shield of the disposable container in a pattern that is synchronized or aligned with deflectors 19 in such manner that duct or flow passage 100 has the shape depicted in FIG. 11. At the same time, the multitude of apertures confines the flow of viscous materials in a specific manner such that the volumetric divide at each bifurcation in duct or flow passage 100 is in the range from 45:55 to 55:45.

FIG. 12 shows a perspective view of a disposable container 48 containing two viscous materials 12, 13 for use in the inventive dispenser. Container 48 comprises a flexible sleeve 49 consisting of two or more polymeric films thermally or adhesively sealed along a contoured seam in order to form a multi-compartment pouch. The thermally or adhesively sealed seam is contoured in a pattern that hems cross-sections of the first and second receptacle $R_1$, $R_2$, the static mixer, connecting ducts between them and two retainer chambers of the inventive dispenser. FIG. 12 shows sleeve 49 in a condition, such as it would occur inside the inventive dispenser under elevated pressure wherein sleeve 49 conforms to the inner surfaces of the dispenser. Contrary to the depiction in FIG. 12, the static mixer portion of container 48, respectively sleeve 49 is configured as cylindrical tube without deflector indentations. In the framework of the present invention the cylindrical tube of the disposable container is also designated as mixing tube. As afore expounded flexible sleeve 49 conforms to the inner surfaces of the inventive dispenser, in particular to the first and second receptacle and the static mixer with the therein contained deflectors. The viscous materials extruded from the first and second receptacle flow through the mixing tube of the disposable container which is confined to a meander-shaped duct or flow passage by the inner surfaces of the static mixer of the inventive dispenser.

In a particularly expedient embodiment the disposable container 48 comprises a carrier sheet (not shown in FIG. 12; cf. FIGS. 13 and 14) made from a polymeric sheet material and sleeve 49 comprises two polymeric films which each are bonded onto one of two opposite surfaces of said carrier sheet. Such carrier sheet imparts container 48 higher mechanical stability, improves handling and facilitates insertion into the inventive dispenser. In further expedient embodiments the disposable container 48 comprises a carrier sheet or a shield with a multitude of apertures contained within the mixing tube of disposable container 48. As afore expounded in conjunction with FIG. 11 the multitude of apertures are arranged in the carrier sheet or shield in a pattern that is synchronized or aligned with the deflectors of the static mixer of the inventive dispenser.

FIG. 13 shows a carrier sheet 110 of a disposable container suited for the inventive dispenser such as depicted in FIG. 12. A sleeve of the disposable container (not shown in FIG. 13) is bonded to the surface of carrier sheet 110 through a contiguous adhesive or seal seam 111. Seam 111 contains an opening or outlet 112. Carrier sheet 110 comprises a multitude of apertures 113 that are contained within a mixing tube of the disposable container (not shown in FIG. 13) and a first and second aperture 115 and 116 for accommodation of a first and, respectively second viscous material. A major portion of the perimeter of aperture 115 and 116 is enclosed by the adhesive or seal seam 111. Seam 111 extends alongside the multitude of apertures 113 and coincides with the boundary of the mixing tube. Seam 111 is patterned in such manner, that the mixing tube of the disposable container extends to the outlet 112 and contains the multitude of apertures 113. As depicted in FIG. 13 carrier sheet 110 may comprise additional apertures for two retainer chambers and a closing and opening valve. Expediently, part of the perimeter of apertures 115 and 116 may be shaped sawtooth-like in order to facilitate breakage of sleeves or tubes encasing the first and second viscous material.

Figure 14:
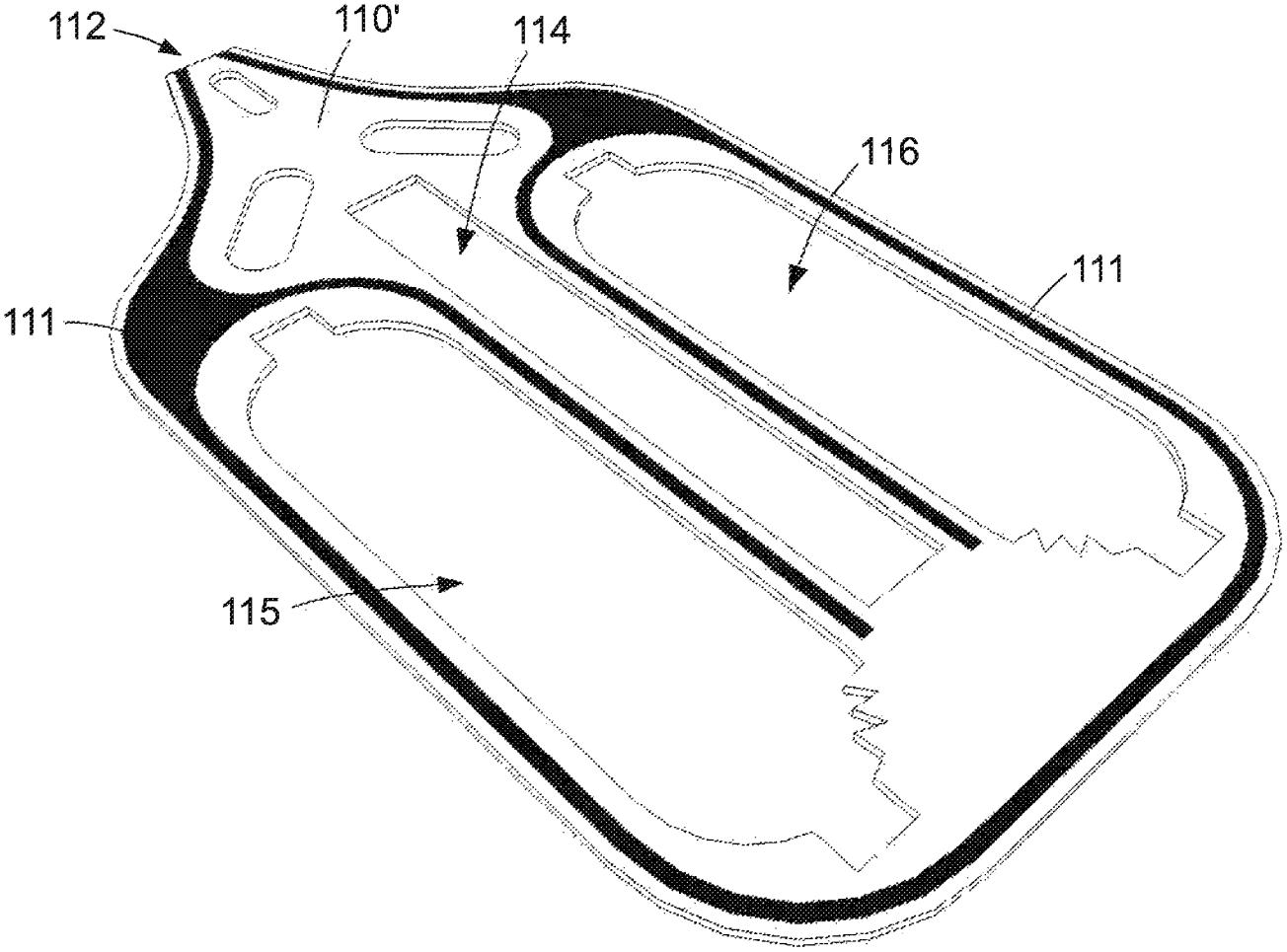
FIG. 14 a schematic illustration of an exemplary carrier sheet of a disposable container with one aperture for a mixing tube.

FIG. 14 shows a carrier sheet 110' of a disposable container suited for another expedient embodiment of the inventive dispenser. A sleeve of the disposable container (not shown in FIG. 14) is bonded to the surface of carrier sheet 110' through a contiguous adhesive or seal seam 111. Seam 111 contains an opening or outlet 112. Carrier sheet 110' comprises one aperture 114 contained within a mixing tube of the disposable container (not shown in FIG. 14) and a first and second aperture 115 and 116 for accommodation of a first and, respectively second viscous material. A major portion of the perimeter of aperture 115 and 116 is enclosed by the adhesive or seal seam 111. Seam 111 extends alongside aperture 114 and coincides with the boundary of the mixing tube. Seam 111 is patterned in such manner, that the mixing tube of the disposable container extends to the outlet 112 and contains aperture 114. As depicted in FIG. 14 carrier sheet 110' may comprise additional apertures for two retainer chambers and a closing and opening valve. Expediently, part of the perimeter of apertures 115 and 116 may be shaped sawtooth-like in order to facilitate breakage of sleeves or tubes encasing the first and second viscous material.

REFERENCE SIGNS

1 . . . dispenser
2 . . . drive
3 . . . power transmission
4 . . . first actuator
5 . . . second actuator
6 . . . first receptacle $R_1$
6A . . . first part of first receptacle $R_1$
6B . . . second part of first receptacle $R_1$
7 . . . second receptacle $R_2$
7A . . . first part of second receptacle $R_2$
7B . . . second part of second receptacle $R_2$
8 . . . outlet of first receptacle $R_1$
9 . . . outlet of second receptacle $R_2$
10 . . . inner surface $S_1$ of first receptacle $R_1$
11 . . . inner surface $S_2$ of second receptacle $R_2$
12 . . . first viscous material
13 . . . second viscous material
14 . . . static mixer
15 . . . static mixer inlet
15A . . . static mixer inlet of first channel of static mixer
15B . . . static mixer inlet of second channel of static mixer
16 . . . static mixer outlet
16A . . . static mixer outlet of first channel of static mixer
16B . . . static mixer outlet of second channel of static mixer
17 . . . first duct
18 . . . second duct
19 . . . deflector
21 . . . valve
21A . . . second flow passage of valve 21
21B . . . first flow passage of valve 21
21C . . . diaphragm of valve 21
22 . . . dispenser frame
23 . . . dispenser lid
24 . . . dispenser hinge
25 . . . retainer chamber
26 . . . retainer chamber
27 . . . first actuator operative surface
28 . . . second actuator operative surface
30 . . . rod of actuator
31 . . . first actuator diaphragm

32 . . . second actuator diaphragm
33 . . . first actuator diaphragm flange
34 . . . second actuator diaphragm flange
35 . . . groove of first receptacle $R_1$ for diaphragm flange
36 . . . groove of second receptacle $R_2$ for diaphragm flange
37 . . . static mixer first channel
38 . . . static mixer second channel
39 . . . principal axis of static mixer first channel
40 . . . principal axis of static mixer second channel
41 . . . inner surface of static mixer first channel
42 . . . inner surface of static mixer second channel
43 . . . diameter of static mixer first channel
44 . . . diameter of static mixer second channel
45 . . . height of static mixer first channel
46 . . . height of static mixer second channel
47 . . . cylindrical body
48 . . . disposable container for viscous materials
49 . . . sleeve of container
50 . . . gasket
51 . . . gasket cut-out for static mixer
100 . . . duct or flow passage
101 . . . meander-shaped duct
102 . . . meander-shaped duct
103 . . . meander-shaped duct
104 . . . meander-shaped duct
110 . . . carrier sheet of disposable container
110' . . . carrier sheet of disposable container
111 . . . adhesive or seal seam
112 . . . opening or outlet
113 . . . multitude of apertures in carrier sheet 110 (contained within mixing tube)
114 . . . single aperture in carrier sheet 110' (contained within mixing tube)
115 . . . aperture for accommodation of first viscous material
116 . . . aperture for accommodation of second viscous material

The invention claimed is:

1. A dispenser comprising
a static mixer;
a first and second receptacle $R_1$ and $R_2$ for a first and, respectively second viscous material, each receptacle $R_1$ and $R_2$ connected in fluid communication with the static mixer;
a first and second actuator configured for discharge of the receptacle $R_1$, and, respectively $R_2$;
an electrically or manually operable drive; and
at least one power transmission configured to translate drive motion into first and second actuator motion,
wherein the static mixer comprises a mixing section that bounds a flow passage comprised of four meander-shaped interconnected ducts.

2. A dispenser comprising
a static mixer;
a first and second receptacle $R_1$ and $R_2$ for a first and, respectively second viscous material, each receptacle $R_1$ and $R_2$ connected in fluid communication with the static mixer;
a first and second actuator configured for discharge of the receptacle $R_1$, and, respectively $R_2$;
an electrically or manually operable drive; and
at least one power transmission configured to translate drive motion into first and second actuator motion,
wherein the first and second receptacle $R_1$ and $R_2$ are configured as cavities having a first and, respectively second principal axis along which $R_1$ and $R_2$ have a maximal spatial extent and the first and, respectively second actuator are configured for translation or for expansion and retraction in a direction perpendicular to the principal axis of the first and, respectively second receptacle $R_1$, $R_2$.

3. The dispenser according to claim 2, wherein the static mixer comprises n deflectors with $8 \leq n \leq 120$.

4. The dispenser according to claim 2, wherein the static mixer comprises a mixing section having an inner surface with a shape corresponding to a union of a lateral-surface of a cylindrical body with elliptical cross-section and the surfaces of n deflectors with $8 \leq n \leq 120$ arranged along a principal axis of the cylindrical body and a major axis of the elliptical cross-section is larger by a factor of 1.1 to 4.0 than the minor axis of the elliptical cross-section.

5. The dispenser according to claim 2, wherein the first and second actuator each comprise a plunger or piston.

6. The dispenser according to claim 2, wherein the first and second actuator each comprise a diaphragm.

7. The dispenser according to claim 2, wherein the dispenser comprises a gasket.

8. The dispenser according to claim 7, wherein each of the first and second actuator comprise a first and, respectively second diaphragm which form integral parts of the gasket.

9. The dispenser according to claim 2, wherein the dispenser comprises a valve for closing and opening of an outlet of the static mixer.

10. The dispenser according to claim 2, said dispenser further comprising a frame and a lid.

11. A dispenser comprising
a static mixer;
a first and second receptacle $R_1$ and $R_2$ for a first and, respectively second viscous material, each receptacle $R_1$ and $R_2$ connected in fluid communication with the static mixer;
a first and second actuator configured for discharge of the receptacle $R_1$, and, respectively $R_2$,
an electrically or manually operable drive; and
at least one power transmission configured to translate drive motion into first and second actuator motion,
wherein the first and second receptacle $R_1$ and $R_2$ have an inner surface $S_1$ and, respectively $S_2$ with a terminal section corresponding to a union of a half-lateral-surface of a cylindrical body having a first and, respectively second principal axis, length $L_1$ along the first principal axis and, respectively length $L_2$ along the second principal axis and polygonal, rectangular, elliptical or circular cross-section with equivalent diameter $D_1$ and, respectively $D_2$ and the surfaces of a first and second half-dome arranged at the cylindrical body front ends.

12. The dispenser according to claim 11, wherein $2 \leq L_1/D_1 \leq 12$ and $2 \leq L_2/D_2 \leq 12$.

13. The dispenser according to claim 11, wherein the first and second actuator have operative surfaces $F_1$ and $F_2$ facing receptacle $R_1$ and, respectively $R_2$ with $$0.8 \cdot D_1\left(L_1 + \frac{\pi}{4}D_1\right) \leq F_1 \leq 1.3 \cdot \frac{\pi}{2}D_1(L_1 + D_1)$$

and, respectively $$0.8 \cdot D_2\left(L_2 + \frac{\pi}{4}D_2\right) \leq F_2 \leq 1.3 \cdot \frac{\pi}{2}D_2(L_2 + D_2).$$

* * * * *